US009365796B2

(12) United States Patent
Bredsguard

(10) Patent No.: US 9,365,796 B2
(45) **Date of Patent: *Jun. 14, 2016**

(54) TWO-CYCLE LUBRICANTS COMPRISING ESTOLIDE COMPOUNDS

(71) Applicant: BIOSYNTHETIC TECHNOLOGIES, LLC, Irvine, CA (US)

(72) Inventor: Jakob Bredsguard, Lake Forest, CA (US)

(73) Assignee: Biosynthetic Technologies, LLC, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/491,261

(22) Filed: Sep. 19, 2014

(65) Prior Publication Data

US 2015/0087570 A1 Mar. 26, 2015

Related U.S. Application Data

(60) Provisional application No. 61/882,396, filed on Sep. 25, 2013.

(51) Int. Cl.

| | |
|---|---|
| ***C07F 5/04*** | (2006.01) |
| ***C07C 69/34*** | (2006.01) |
| ***C10M 173/02*** | (2006.01) |
| ***C07C 59/147*** | (2006.01) |
| ***C10M 169/04*** | (2006.01) |
| ***C10M 105/40*** | (2006.01) |
| ***C10M 105/42*** | (2006.01) |

(52) U.S. Cl.

CPC ..... *C10M 169/04* (2013.01); *C10M 105/40* (2013.01); *C10M 105/42* (2013.01); *C10M 2205/026* (2013.01); *C10M 2207/281* (2013.01); *C10M 2207/288* (2013.01); *C10M 2207/301* (2013.01); *C10M 2215/064* (2013.01); *C10M 2219/046* (2013.01); *C10N 2210/02* (2013.01); *C10N 2220/022* (2013.01); *C10N 2230/02* (2013.01); *C10N 2230/04* (2013.01); *C10N 2230/06* (2013.01); *C10N 2240/105* (2013.01)

(58) Field of Classification Search

CPC ..... C10M 2207/282; C10N 2210/02; C10G 33/04; C08G 63/06

USPC ..... 508/465, 532; 554/122

See application file for complete search history.

(56) References Cited

U.S. PATENT DOCUMENTS

| | | | | |
|---|---|---|---|---|
| 3,852,205 | A | 12/1974 | Kablaoui et al. | |
| 4,028,258 | A | 6/1977 | Kablaoui et al. | |
| 8,236,194 | B1 * | 8/2012 | Bredsguard | C09K 5/044 252/67 |
| 8,258,326 | B1 * | 9/2012 | Forest | C08K 5/1515 549/512 |
| 8,268,199 | B1 * | 9/2012 | Forest | C10M 105/42 252/570 |
| 8,287,754 | B1 * | 10/2012 | Bredsguard | C09K 5/044 252/68 |
| 8,372,301 | B2 * | 2/2013 | Bredsguard | C10M 169/04 252/68 |
| 8,450,256 | B2 * | 5/2013 | Bredsguard | C07C 69/675 508/465 |
| 8,486,875 | B2 * | 7/2013 | Bredsguard | C07C 69/675 508/465 |
| 8,512,592 | B2 * | 8/2013 | Forest | C10M 105/42 252/67 |
| 8,541,351 | B2 | 9/2013 | Thompson et al. | |
| 8,633,143 | B2 | 1/2014 | Thompson et al. | |
| 8,716,206 | B2 * | 5/2014 | Bredsguard | C07C 69/675 508/465 |
| 8,877,695 | B2 | 11/2014 | Thompson et al. | |
| 2008/0274921 | A1 * | 11/2008 | MacPherson et al. | 508/287 |
| 2012/0083435 | A1 * | 4/2012 | Bredsguard | C07C 69/675 508/496 |
| 2012/0172269 | A1 * | 7/2012 | Greaves | C09K 8/34 508/474 |
| 2012/0322707 | A1 * | 12/2012 | Bredsguard | C10M 169/02 508/465 |
| 2012/0322897 | A1 * | 12/2012 | Bredsguard | C10M 169/04 514/785 |
| 2013/0023454 | A1 * | 1/2013 | Bredsguard | C09K 5/044 508/496 |
| 2013/0065970 | A1 * | 3/2013 | Bredsguard | A61K 8/37 514/785 |
| 2013/0102510 | A1 * | 4/2013 | Thompson | C10M 169/04 508/511 |
| 2013/0172223 | A1 * | 7/2013 | Thompson | C09K 5/044 508/408 |
| 2013/0338050 | A1 * | 12/2013 | Bredsguard | C10M 169/04 508/465 |
| 2013/0340246 | A1 * | 12/2013 | Thompson | C10M 105/42 29/602.1 |
| 2014/0012023 | A1 * | 1/2014 | Thompson | C07C 69/604 554/122 |
| 2015/0005212 | A1 * | 1/2015 | Bredsguard | C07C 69/675 508/465 |
| 2015/0045430 | A1 * | 2/2015 | Parson | A61K 8/37 514/547 |
| 2015/0087569 | A1 | 3/2015 | Forest et al. | |
| 2015/0094246 | A1 | 4/2015 | Bredsguard | |
| 2015/0210950 | A1 * | 7/2015 | Bredsguard | C07C 69/675 508/465 |

OTHER PUBLICATIONS

International Search Report and Written Opinion for PCT/US2014/056522, mailed Dec. 17, 2014.

Notice of Allowance Dated Dec. 3, 2012 for U.S. Appl. No. 13/483,602, filed May 30, 2012.

Notice of Allowance dated Aug. 20, 2012, for U.S. Appl. No. 13/531,923, filed Jun. 25, 2012.

Notice of Allowance dated Dec. 6, 2013, for U.S. Appl. No. 13/754,775, filed Jan. 30, 2013.

Notice of Allowance dated Jul. 19, 2013, for U.S. Appl. No. 13/705,543, filed Dec. 5, 2012.

Office Action Dated Sep. 14, 2012, for U.S. Appl. No. 13/483,602, filed May 30, 2012.

Office Action dated Feb. 13, 2015, for U.S. Appl. No. 13/950,508, filed Jul. 25, 2013.

Office Action dated Mar. 28, 2013, for U.S. Appl. No. 13/705,543, filed Dec. 5, 2012.

Office Action dated Sep. 3, 2013, for U.S. Appl. No. 13/754,775, filed Jan. 30, 2013.

* cited by examiner

*Primary Examiner* — Vishal Vasisth

(74) *Attorney, Agent, or Firm* — Jeremy Forest

(57) ABSTRACT

Estolide compounds and compositions, including two-cycle lubricating compositions comprising at least one estolide compound. Exemplary two-cycle lubricating compositions comprise an estolide base oil and an additive package.

13 Claims, No Drawings

TWO-CYCLE LUBRICANTS COMPRISING ESTOLIDE COMPOUNDS

This application claims benefit of 61/882,396, filed Sep. 25, 2013.

FIELD

The present disclosure relates two-cycle lubricants containing one or more estolide compounds.

BACKGROUND

Two-cycle engines are lubricated by mixing the fuel and lubricant and allowing the mixed composition to pass through the engine. Various types of two-cycle oils, compatible with fuel, have been described. Such oils often contain a variety of additive components in order for the oil to pass industry standard tests to permit use in two-cycle engines. However, the use of two-cycle lubricants may result in the dispersion of such lubricants into waterways, such as rivers, oceans and lakes. The petroleum base stock and additives of common two-cycle formulations are typically non-biodegradable and can be toxic. Thus, the preparation and use of two-cycle lubricants comprising biodegradable base oils is desirable and has generated interest by both the environmental community and lubricant manufacturers.

SUMMARY

Described herein are two-cycle lubricant compositions comprising at least one estolide compound, and methods of making the same. In one embodiment, the two-cycle lubricant comprises an additive package; and at least one estolide compound selected from compounds of Formula I:

Formula I

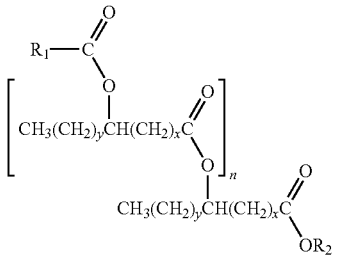

wherein x is, independently for each occurrence, an integer selected from 0 to 20;

y is, independently for each occurrence, an integer selected from 0 to 20;

n is an integer equal to or greater than 0;

$R_1$ is an optionally substituted alkyl that is saturated or unsaturated, and branched or unbranched; and $R_2$ is selected from hydrogen and optionally substituted alkyl that is saturated or unsaturated, and branched or unbranched;

wherein each fatty acid chain residue of said at least one estolide compound is independently optionally substituted.

In certain embodiments, the two-cycle lubricant comprises an additive package; and at least one estolide compound selected from compounds of Formula II:

Formula II

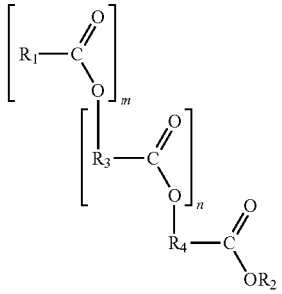

wherein m is an integer equal to or greater than 1;

n is an integer equal to or greater than 0;

$R_1$, independently for each occurrence, is an optionally substituted alkyl that is saturated or unsaturated, and branched or unbranched;

$R_2$ is selected from hydrogen and optionally substituted alkyl that is saturated or unsaturated, and branched or unbranched; and $R_3$ and $R_4$, independently for each occurrence, are selected from optionally substituted alkyl that is saturated or unsaturated, and branched or unbranched.

DETAILED DESCRIPTION

The estolide compositions described herein may exhibit superior oxidative stability when compared to other lubricant and/or estolide-containing compositions. Exemplary compositions include, but are not limited to, coolants, fire-resistant and/or non-flammable fluids, dielectric fluids such as transformer fluids, greases, drilling fluids, crankcase oils, hydraulic fluids, passenger car motor oils, two- and four-stroke lubricants, metalworking fluids, food-grade lubricants, refrigerating fluids, compressor fluids, and plasticized compositions.

The use of lubricants and lubricating fluid compositions may result in the dispersion of such fluids, compounds, and/or compositions in the environment. Petroleum base oils used in common lubricant compositions, as well as additives, are typically non-biodegradable and can be toxic. The present disclosure provides for the preparation and use of compositions comprising partially or fully biodegradable base oils, including base oils comprising one or more estolides.

In certain embodiments, the lubricants and/or compositions comprising one or more estolides are partially or fully biodegradable and thereby pose diminished risk to the environment. In certain embodiments, the lubricants and/or compositions meet guidelines set for by the Organization for Economic Cooperation and Development (OECD) for degradation and accumulation testing. The OECD has indicated that several tests may be used to determine the "ready biodegradability" of organic chemicals. Aerobic ready biodegradability by OECD 301D measures the mineralization of the test sample to $CO_2$ in closed aerobic microcosms that simulate an aerobic aquatic environment, with microorganisms seeded from a waste-water treatment plant. OECD 301D is considered representative of most aerobic environments that are likely to receive waste materials. Aerobic "ultimate biodegradability" can be determined by OECD 302D. Under OECD 302D, microorganisms are pre-acclimated to biodegradation of the test material during a pre-incubation period, then incubated in sealed vessels with relatively high concentrations of microorganisms and enriched mineral salts medium. OECD 302D ultimately determines whether the test materials are completely biodegradable, albeit under less stringent conditions than "ready biodegradability" assays.

As used in the present specification, the following words, phrases and symbols are generally intended to have the meanings as set forth below, except to the extent that the context in which they are used indicates otherwise. The following abbreviations and terms have the indicated meanings throughout:

A dash ("-") that is not between two letters or symbols is used to indicate a point of attachment for a substituent. For example, —$C(O)NH_2$ is attached through the carbon atom.

"Alkoxy" by itself or as part of another substituent refers to a radical —$OR^{31}$ where $R^{31}$ is alkyl, cycloalkyl, cycloalkylalkyl, aryl, or arylalkyl, which can be substituted, as defined herein. In some embodiments, alkoxy groups have from 1 to 8 carbon atoms. In some embodiments, alkoxy groups have 1, 2, 3, 4, 5, 6, 7, or 8 carbon atoms. Examples of alkoxy groups include, but are not limited to, methoxy, ethoxy, propoxy, butoxy, cyclohexyloxy, and the like.

"Alkyl" by itself or as part of another substituent refers to a saturated or unsaturated, branched, or straight-chain monovalent hydrocarbon radical derived by the removal of one hydrogen atom from a single carbon atom of a parent alkane, alkene, or alkyne. Examples of alkyl groups include, but are not limited to, methyl; ethyls such as ethanyl, ethenyl, and ethynyl; propyls such as propan-1-yl, propan-2-yl, prop-1-en-1-yl, prop-1-en-2-yl, prop-2-en-1-yl(allyl), prop-1-yn-1-yl, prop-2-yn-1-yl, etc.; butyls such as butan-1-yl, butan-2-yl, 2-methyl-propan-1-yl, 2-methyl-propan-2-yl, but-1-en-1-yl, but-1-en-2-yl, 2-methyl-prop-1-en-1-yl, but-2-en-1-yl, but-2-en-2-yl, buta-1,3-dien-1-yl, buta-1,3-dien-2-yl, but-1-yn-1-yl, but-1-yn-3-yl, but-3-yn-1-yl, etc.; and the like.

Unless otherwise indicated, the term "alkyl" is specifically intended to include groups having any degree or level of saturation, i.e., groups having exclusively single carbon-carbon bonds, groups having one or more double carbon-carbon bonds, groups having one or more triple carbon-carbon bonds, and groups having mixtures of single, double, and triple carbon-carbon bonds. Where a specific level of saturation is intended, the terms "alkanyl," "alkenyl," and "alkynyl" are used. In certain embodiments, an alkyl group comprises from 1 to 40 carbon atoms, in certain embodiments, from 1 to 22 or 1 to 18 carbon atoms, in certain embodiments, from 1 to 16 or 1 to 8 carbon atoms, and in certain embodiments from 1 to 6 or 1 to 3 carbon atoms. In certain embodiments, an alkyl group comprises from 8 to 22 carbon atoms, in certain embodiments, from 8 to 18 or 8 to 16. In some embodiments, the alkyl group comprises from 3 to 20 or 7 to 17 carbons. In some embodiments, the alkyl group comprises 1, 2, 3, 4, 5, 6, 7, 8, 9, 10, 11, 12, 13, 14, 15, 16, 17, 18, 19, 20, 21, or 22 carbon atoms.

"Aryl" by itself or as part of another substituent refers to a monovalent aromatic hydrocarbon radical derived by the removal of one hydrogen atom from a single carbon atom of a parent aromatic ring system. Aryl encompasses 5- and 6-membered carbocyclic aromatic rings, for example, benzene; bicyclic ring systems wherein at least one ring is carbocyclic and aromatic, for example, naphthalene, indane, and tetralin; and tricyclic ring systems wherein at least one ring is carbocyclic and aromatic, for example, fluorene. Aryl encompasses multiple ring systems having at least one carbocyclic aromatic ring fused to at least one carbocyclic aromatic ring, cycloalkyl ring, or heterocycloalkyl ring. For example, aryl includes 5- and 6-membered carbocyclic aromatic rings fused to a 5- to 7-membered non-aromatic heterocycloalkyl ring containing one or more heteroatoms chosen from N, O, and S. For such fused, bicyclic ring systems wherein only one of the rings is a carbocyclic aromatic ring, the point of attachment may be at the carbocyclic aromatic ring or the heterocycloalkyl ring. Examples of aryl groups include, but are not limited to, groups derived from aceanthrylene, acenaphthylene, acephenanthrylene, anthracene, azulene, benzene, chrysene, coronene, fluoranthene, fluorene, hexacene, hexaphene, hexalene, as-indacene, s-indacene, indane, indene, naphthalene, octacene, octaphene, octalene, ovalene, penta-2,4-diene, pentacene, pentalene, pentaphene, perylene, phenalene, phenanthrene, picene, pleiadene, pyrene, pyranthrene, rubicene, triphenylene, trinaphthalene, and the like. In certain embodiments, an aryl group can comprise from 5 to 20 carbon atoms, and in certain embodiments, from 5 to 12 carbon atoms. In certain embodiments, an aryl group can comprise 5, 6, 7, 8, 9, 10, 11, 12, 13, 14, 15, 16, 17, 18, 19, or 20 carbon atoms. Aryl, however, does not encompass or overlap in any way with heteroaryl, separately defined herein. Hence, a multiple ring system in which one or more carbocyclic aromatic rings is fused to a heterocycloalkyl aromatic ring, is heteroaryl, not aryl, as defined herein.

"Arylalkyl" by itself or as part of another substituent refers to an acyclic alkyl radical in which one of the hydrogen atoms bonded to a carbon atom, typically a terminal or $sp^3$ carbon atom, is replaced with an aryl group. Examples of arylalkyl groups include, but are not limited to, benzyl, 2-phenylethan-1-yl, 2-phenylethen-1-yl, naphthylmethyl, 2-naphthylethan-1-yl, 2-naphthylethen-1-yl, naphthobenzyl, 2-naphthophenylethan-1-yl, and the like. Where specific alkyl moieties are intended, the nomenclature arylalkanyl, arylalkenyl, or arylalkynyl is used. In certain embodiments, an arylalkyl group is $C_{7-30}$ arylalkyl, e.g., the alkanyl, alkenyl, or alkynyl moiety of the arylalkyl group is $C_{1-10}$ and the aryl moiety is $C_{6-20}$, and in certain embodiments, an arylalkyl group is $C_{7-20}$ arylalkyl, e.g., the alkanyl, alkenyl, or alkynyl moiety of the arylalkyl group is $C_{1-8}$ and the aryl moiety is $C_{6-12}$.

Estolide "base oil" and "base stock", unless otherwise indicated, refer to any composition comprising one or more estolide compounds. It should be understood that an estolide "base oil" or "base stock" is not limited to compositions for a particular use, and may generally refer to compositions comprising one or more estolides, including mixtures of estolides. Estolide base oils and base stocks can also include compounds other than estolides.

"Antioxidant" refers to a substance that is capable of inhibiting, preventing, reducing, or ameliorating oxidative reactions in another substance (e.g., base oil such as an estolide compound) when the antioxidant is used in a composition (e.g., lubricant formulation) that includes such other substances. An example of an "antioxidant" is an oxygen scavenger.

"Compounds" refers to compounds encompassed by structural Formula I and II herein and includes any specific compounds within the formula whose structure is disclosed herein. Compounds may be identified either by their chemical structure and/or chemical name. When the chemical structure and chemical name conflict, the chemical structure is determinative of the identity of the compound. The compounds described herein may contain one or more chiral centers and/or double bonds and therefore may exist as stereoisomers such as double-bond isomers (i.e., geometric isomers), enantiomers, or diastereomers. Accordingly, any chemical structures within the scope of the specification depicted, in whole or in part, with a relative configuration encompass all possible enantiomers and stereoisomers of the illustrated compounds including the stereoisomerically pure form (e.g., geometrically pure, enantiomerically pure, or diastereomerically pure) and enantiomeric and stereoisomeric mixtures. Enantiomeric and stereoisomeric mixtures may be resolved into their component enantiomers or stereoisomers using separation techniques or chiral synthesis techniques well known to the skilled artisan.

For the purposes of the present disclosure, "chiral compounds" are compounds having at least one center of chirality (i.e. at least one asymmetric atom, in particular at least one asymmetric C atom), having an axis of chirality, a plane of chirality or a screw structure. "Achiral compounds" are compounds which are not chiral.

Compounds of Formula I and II include, but are not limited to, optical isomers of compounds of Formula I and II, racemates thereof, and other mixtures thereof. In such embodiments, the single enantiomers or diastereomer I and II s, i.e., optically active forms, can be obtained by asymmetric synthesis or by resolution of the racemates. Resolution of the racemates may be accomplished by, for example, chromatography, using, for example a chiral high-pressure liquid chromatography (HPLC) column. However, unless otherwise stated, it should be assumed that Formula I and II cover all asymmetric variants of the compounds described herein, including isomers, racemates, enantiomers, diastereomers, and other mixtures thereof. In addition, compounds of Formula I and II include Z- and E-forms (e.g., cis- and trans-forms) of compounds with double bonds. The compounds of Formula I and II may also exist in several tautomeric forms including the enol form, the keto form, and mixtures thereof. Accordingly, the chemical structures depicted herein encompass all possible tautomeric forms of the illustrated compounds.

"Cycloalkyl" by itself or as part of another substituent refers to a saturated or unsaturated cyclic alkyl radical. Where a specific level of saturation is intended, the nomenclature "cycloalkanyl" or "cycloalkenyl" is used. Examples of cycloalkyl groups include, but are not limited to, groups derived from cyclopropane, cyclobutane, cyclopentane, cyclohexane, and the like. In certain embodiments, a cycloalkyl group is $C_{3-15}$ cycloalkyl, and in certain embodiments, $C_{3-12}$ cycloalkyl or $C_{5-12}$ cycloalkyl. In certain embodiments, a cycloalkyl group is a $C_5$, $C_6$, $C_7$, $C_8$, $C_9$, $C_{10}$, $C_{11}$, $C_{12}$, $C_{13}$, $C_{14}$, or $C_{15}$ cycloalkyl.

"Cycloalkylalkyl" by itself or as part of another substituent refers to an acyclic alkyl radical in which one of the hydrogen atoms bonded to a carbon atom, typically a terminal or $sp^3$ carbon atom, is replaced with a cycloalkyl group. Where specific alkyl moieties are intended, the nomenclature cycloalkylalkanyl, cycloalkylalkenyl, or cycloalkylalkynyl is used. In certain embodiments, a cycloalkylalkyl group is $C_{7-30}$ cycloalkylalkyl, e.g., the alkanyl, alkenyl, or alkynyl moiety of the cycloalkylalkyl group is $C_{1-10}$ and the cycloalkyl moiety is $C_{6-20}$, and in certain embodiments, a cycloalkylalkyl group is $C_{7-20}$ cycloalkylalkyl, e.g., the alkanyl, alkenyl, or alkynyl moiety of the cycloalkylalkyl group is $C_{1-8}$ and the cycloalkyl moiety is $C_{4-20}$ or $C_{6-12}$.

"Halogen" refers to a fluoro, chloro, bromo, or iodo group.

"Heteroaryl" by itself or as part of another substituent refers to a monovalent heteroaromatic radical derived by the removal of one hydrogen atom from a single atom of a parent heteroaromatic ring system. Heteroaryl encompasses multiple ring systems having at least one aromatic ring fused to at least one other ring, which can be aromatic or non-aromatic in which at least one ring atom is a heteroatom. Heteroaryl encompasses 5- to 12-membered aromatic, such as 5- to 7-membered, monocyclic rings containing one or more, for example, from 1 to 4, or in certain embodiments, from 1 to 3, heteroatoms chosen from N, 0, and S, with the remaining ring atoms being carbon; and bicyclic heterocycloalkyl rings containing one or more, for example, from 1 to 4, or in certain embodiments, from 1 to 3, heteroatoms chosen from N, O, and S, with the remaining ring atoms being carbon and wherein at least one heteroatom is present in an aromatic ring. For example, heteroaryl includes a 5- to 7-membered heterocycloalkyl, aromatic ring fused to a 5- to 7-membered cycloalkyl ring. For such fused, bicyclic heteroaryl ring systems wherein only one of the rings contains one or more heteroatoms, the point of attachment may be at the heteroaromatic ring or the cycloalkyl ring. In certain embodiments, when the total number of N, S, and O atoms in the heteroaryl group exceeds one, the heteroatoms are not adjacent to one another. In certain embodiments, the total number of N, S, and O atoms in the heteroaryl group is not more than two. In certain embodiments, the total number of N, S, and O atoms in the aromatic heterocycle is not more than one. Heteroaryl does not encompass or overlap with aryl as defined herein.

Examples of heteroaryl groups include, but are not limited to, groups derived from acridine, arsindole, carbazole, β-carboline, chromane, chromene, cinnoline, furan, imidazole, indazole, indole, indoline, indolizine, isobenzofuran, isochromene, isoindole, isoindoline, isoquinoline, isothiazole, isoxazole, naphthyridine, oxadiazole, oxazole, perimidine, phenanthridine, phenanthroline, phenazine, phthalazine, pteridine, purine, pyran, pyrazine, pyrazole, pyridazine, pyridine, pyrimidine, pyrrole, pyrrolizine, quinazoline, quinoline, quinolizine, quinoxaline, tetrazole, thiadiazole, thiazole, thiophene, triazole, xanthene, and the like. In certain embodiments, a heteroaryl group is from 5- to 20-membered heteroaryl, and in certain embodiments from 5- to 12-membered heteroaryl or from 5- to 10-membered heteroaryl. In certain embodiments, a heteroaryl group is a 5-, 6-, 7-, 8-, 9-, 10-, 11-, 12-, 13-, 14-, 15-, 16-, 17-, 18-, 19-, or 20-membered heteroaryl. In certain embodiments heteroaryl groups are those derived from thiophene, pyrrole, benzothiophene, benzofuran, indole, pyridine, quinoline, imidazole, oxazole, and pyrazine.

"Heteroarylalkyl" by itself or as part of another substituent refers to an acyclic alkyl radical in which one of the hydrogen atoms bonded to a carbon atom, typically a terminal or $sp^3$ carbon atom, is replaced with a heteroaryl group. Where specific alkyl moieties are intended, the nomenclature heteroarylalkanyl, heteroarylalkenyl, or heteroarylalkynyl is used. In certain embodiments, a heteroarylalkyl group is a 6- to 30-membered heteroarylalkyl, e.g., the alkanyl, alkenyl, or alkynyl moiety of the heteroarylalkyl is 1- to 10-membered and the heteroaryl moiety is a 5- to 20-membered heteroaryl, and in certain embodiments, 6- to 20-membered heteroarylalkyl, e.g., the alkanyl, alkenyl, or alkynyl moiety of the heteroarylalkyl is 1- to 8-membered and the heteroaryl moiety is a 5- to 12-membered heteroaryl.

"Heterocycloalkyl" by itself or as part of another substituent refers to a partially saturated or unsaturated cyclic alkyl radical in which one or more carbon atoms (and any associated hydrogen atoms) are independently replaced with the same or different heteroatom. Examples of heteroatoms to replace the carbon atom(s) include, but are not limited to, N, P, O, S, Si, etc. Where a specific level of saturation is intended, the nomenclature "heterocycloalkanyl" or "heterocycloalkenyl" is used. Examples of heterocycloalkyl groups include, but are not limited to, groups derived from epoxides, azirines, thiiranes, imidazolidine, morpholine, piperazine, piperidine, pyrazolidine, pyrrolidine, quinuclidine, and the like.

"Heterocycloalkylalkyl" by itself or as part of another substituent refers to an acyclic alkyl radical in which one of the hydrogen atoms bonded to a carbon atom, typically a terminal or $sp^3$ carbon atom, is replaced with a heterocycloalkyl group. Where specific alkyl moieties are intended, the nomenclature heterocycloalkylalkanyl, heterocycloalkylalkenyl, or heterocycloalkylalkynyl is used. In certain embodiments, a heterocycloalkylalkyl group is a 6- to 30-membered heterocycloalkylalkyl, e.g., the alkanyl, alkenyl, or alkynyl moiety of the heterocycloalkylalkyl is 1- to 10-membered and the heterocycloalkyl moiety is a 5- to 20-membered heterocycloalkyl, and in certain embodiments, 6- to 20-membered heterocycloalkylalkyl, e.g., the alkanyl, alkenyl, or alkynyl moiety of the heterocycloalkylalkyl is 1- to 8-membered and the heterocycloalkyl moiety is a 5- to 12-membered heterocycloalkyl.

"Mixture" refers to a collection of molecules or chemical substances. Each component in a mixture can be independently varied. A mixture may contain, or consist essentially of, two or more substances intermingled with or without a constant percentage composition, wherein each component may or may not retain its essential original properties, and where molecular phase mixing may or may not occur. In mixtures, the components making up the mixture may or may not remain distinguishable from each other by virtue of their chemical structure.

"Parent aromatic ring system" refers to an unsaturated cyclic or polycyclic ring system having a conjugated π (pi) electron system. Included within the definition of "parent aromatic ring system" are fused ring systems in which one or more of the rings are aromatic and one or more of the rings are saturated or unsaturated, such as, for example, fluorene, indane, indene, phenalene, etc. Examples of parent aromatic ring systems include, but are not limited to, aceanthrylene, acenaphthylene, acephenanthrylene, anthracene, azulene, benzene, chrysene, coronene, fluoranthene, fluorene, hexacene, hexaphene, hexalene, as-indacene, s-indacene, indane, indene, naphthalene, octacene, octaphene, octalene, ovalene, penta-2,4-diene, pentacene, pentalene, pentaphene, perylene, phenalene, phenanthrene, picene, pleiadene, pyrene, pyranthrene, rubicene, triphenylene, trinaphthalene, and the like.

"Parent heteroaromatic ring system" refers to a parent aromatic ring system in which one or more carbon atoms (and any associated hydrogen atoms) are independently replaced with the same or different heteroatom. Examples of heteroatoms to replace the carbon atoms include, but are not limited to, N, P, O, S, Si, etc. Specifically included within the definition of "parent heteroaromatic ring systems" are fused ring systems in which one or more of the rings are aromatic and one or more of the rings are saturated or unsaturated, such as, for example, arsindole, benzodioxan, benzofuran, chromane, chromene, indole, indoline, xanthene, etc. Examples of parent heteroaromatic ring systems include, but are not limited to, arsindole, carbazole, β-carboline, chromane, chromene, cinnoline, furan, imidazole, indazole, indole, indoline, indolizine, isobenzofuran, isochromene, isoindole, isoindoline, isoquinoline, isothiazole, isoxazole, naphthyridine, oxadiazole, oxazole, perimidine, phenanthridine, phenanthroline, phenazine, phthalazine, pteridine, purine, pyran, pyrazine, pyrazole, pyridazine, pyridine, pyrimidine, pyrrole, pyrrolizine, quinazoline, quinoline, quinolizine, quinoxaline, tetrazole, thiadiazole, thiazole, thiophene, triazole, xanthene, and the like.

"Substituted" refers to a group in which one or more hydrogen atoms are independently replaced with the same or different substituent(s). Examples of substituents include, but are not limited to, $—R^{64}$, $—R^{60}$, $—O^-$, —OH, =O, $—OR^{60}$, $—SR^{60}$, $—S^-$, =S, $—NR^{60}R^{61}$, $=NR^{60}$, —CN, $—CF_3$, —OCN, —SCN, —NO, $—NO_2$, $=N_2$, $—N_3$, $—S(O)_2O^-$, $—S(O)_2OH$, $—S(O)_2R^{60}$, $—OS(O_2)O^-$, $—OS(O)_2R^{60}$, $—P(O)(O^-)_2$, $—P(O)(OR^{60})(O^-)$, $—OP(O)(OR^{60})(OR^{61})$, $—C(O)R^{60}$, $—C(S)R^{60}$, $—C(O)OR^{60}$, $—C(O)NR^{60}R^{61}$, $—C(O)O^-$, $—C(S)OR^{60}$, $—NR^{62}C(O)NR^{60}R^{61}$, $—NR^{62}C(S)NR^{60}R^{61}$, $—NR^{62}C(NR^{63})NR^{60}R^{61}$, $—C(NR^{62})NR^{60}R^{61}$, $—S(O)_2$, $NR^{60}R^{61}$, $—NR^{63}S(O)_2R^{60}$, $—NR^{63}C(O)R^{60}$, and $—S(O)R^{60}$;

wherein each $—R^{64}$ is independently a halogen; each $R^{60}$ and $R^{61}$ are independently alkyl, substituted alkyl, alkoxy, substituted alkoxy, cycloalkyl, substituted cycloalkyl, heterocycloalkyl, substituted heterocycloalkyl, aryl, substituted aryl, heteroaryl, substituted heteroaryl, arylalkyl, substituted arylalkyl, heteroarylalkyl, or substituted heteroarylalkyl, or $R^{60}$ and $R^{61}$ together with the nitrogen atom to which they are bonded form a heterocycloalkyl, substituted heterocycloalkyl, heteroaryl, or substituted heteroaryl ring, and $R^{62}$ and $R^{63}$ are independently alkyl, substituted alkyl, aryl, substituted aryl, arylalkyl, substituted arylalkyl, cycloalkyl, substituted cycloalkyl, heterocycloalkyl, substituted heterocycloalkyl, heteroaryl, substituted heteroaryl, heteroarylalkyl, or substituted heteroarylalkyl, or $R^{62}$ and $R^{63}$ together with the atom to which they are bonded form one or more heterocycloalkyl, substituted heterocycloalkyl, heteroaryl, or substituted heteroaryl rings;

wherein the "substituted" substituents, as defined above for $R^{60}$, $R^{61}$, $R^{62}$, and $R^{63}$, are substituted with one or more, such as one, two, or three, groups independently selected from alkyl, -alkylOH, O-haloalkyl, alkyl$NH_2$, alkoxy, cycloalkyl, cycloalkylalkyl, heterocycloalkyl, heterocycloalkylalkyl, aryl, heteroaryl, arylalkyl, heteroarylalkyl, $—O^-$, —OH, =O, —O-alkyl, —O-aryl, —O-heteroarylalkyl, —O-cycloalkyl, —O-heterocycloalkyl, —SH, $—S^-$, =S, —S-alkyl, —S-aryl, —S-heteroarylalkyl, —S-cycloalkyl, —S-heterocycloalkyl, $—NH_2$, =NH, —CN, $—CF_3$, —OCN, —SCN, —NO, $—NO_2$, $=N_2$, $—N_3$, $—S(O)_2O$, $—S(O)_2$, $—S(O)_2OH$, $—OS(O_2)O$, $—SO_2$(alkyl), $—SO_2$(phenyl), $—SO_2$(haloalkyl), $—SO_2NH_2$, $SO_2NH$(alkyl), $SO_2NH$(phenyl), $—P(O)(O^-)_2$, $—P(O)$(O-alkyl)$(O^-)$, —OP(O)(O-alkyl)(O-alkyl), $CO_2H$, C(O)O(alkyl), CON(alkyl)(alkyl), —CONH(alkyl), $CONH_2$, C(O)(alkyl), C(O)(phenyl), C(O)(haloalkyl), OC(O)(alkyl), N(alkyl)(alkyl), NH(alkyl), N(alkyl)(alkylphenyl), NH(alkylphenyl), NHC(O)(alkyl), NHC(O)(phenyl), —N(alkyl)C(O)(alkyl), and N(alkyl)C(O)(phenyl).

As used in this specification and the appended claims, the articles "a," "an," and "the" include plural referents unless expressly and unequivocally limited to one referent.

All numerical ranges herein include all numerical values and ranges of all numerical values within the recited range of numerical values.

The present disclosure relates to two-cycle lubricating compositions comprising one or more estolide compounds, and methods of making the same. In one embodiment, the two-cycle lubricating composition comprises an additive package; and at least one estolide compound selected from compounds of Formula I:

Formula I

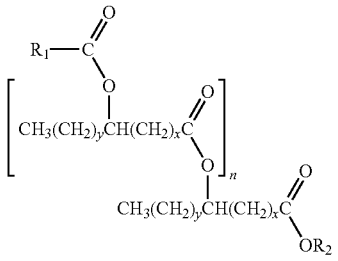

wherein x is, independently for each occurrence, an integer selected from 0 to 20;

y is, independently for each occurrence, an integer selected from 0 to 20;

n is an integer equal to or greater than 0;

$R_1$ is an optionally substituted alkyl that is saturated or unsaturated, and branched or unbranched; and $R_2$ is selected from hydrogen and optionally substituted alkyl that is saturated or unsaturated, and branched or unbranched;

wherein each fatty acid chain residue of said at least one estolide compound is independently optionally substituted.

In certain embodiments, the two-cycle lubricant composition comprises an additive package; and at least one estolide compound selected from compounds of Formula II:

Formula II

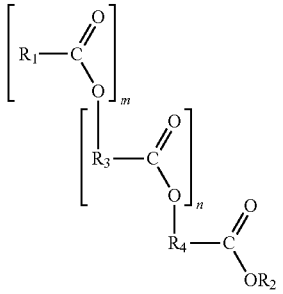

wherein m is an integer equal to or greater than 1;

n is an integer equal to or greater than 0;

$R_1$, independently for each occurrence, is an optionally substituted alkyl that is saturated or unsaturated, and branched or unbranched;

$R_2$ is selected from hydrogen and optionally substituted alkyl that is saturated or unsaturated, and branched or unbranched; and $R_3$ and $R_4$, independently for each occurrence, are selected from optionally substituted alkyl that is saturated or unsaturated, and branched or unbranched.

In certain embodiments, the composition comprises at least one estolide compound of Formula I or II where $R_1$ is hydrogen.

The terms "chain" or "fatty acid chain" or "fatty acid chain residue," as used with respect to the estolide compounds of Formula I and II, refer to one or more of the fatty acid residues incorporated in estolide compounds, e.g., $R_3$ or $R_4$ of Formula II, or the structures represented by $CH_3(CH_2)_yCH(CH_2)_xC(O)O$— in Formula I.

The $R_1$ in Formula I and II at the top of each Formula shown is an example of what may be referred to as a "cap" or "capping material," as it "caps" the top of the estolide. Similarly, the capping group may be an organic acid residue of general formula —OC(O)-alkyl, i.e., a carboxylic acid with a substituted or unsubstituted, saturated or unsaturated, and/or branched or unbranched alkyl as defined herein, or a formic acid residue. In certain embodiments, the "cap" or "capping group" is a fatty acid. In certain embodiments, the capping group, regardless of size, is substituted or unsubstituted, saturated or unsaturated, and/or branched or unbranched. The cap or capping material may also be referred to as the primary or alpha (α) chain.

Depending on the manner in which the estolide is synthesized, the cap or capping group alkyl may be the only alkyl from an organic acid residue in the resulting estolide that is unsaturated. In certain embodiments, it may be desirable to use a saturated organic or fatty-acid cap to increase the overall saturation of the estolide and/or to increase the resulting estolide's stability. For example, in certain embodiments, it may be desirable to provide a method of providing a saturated capped estolide by hydrogenating an unsaturated cap using any suitable methods available to those of ordinary skill in the art. Hydrogenation may be used with various sources of the fatty-acid feedstock, which may include mono- and/or polyunsaturated fatty acids. Without being bound to any particular theory, in certain embodiments, hydrogenating the estolide may help to improve the overall stability of the molecule. However, a fully-hydrogenated estolide, such as an estolide with a larger fatty acid cap, may exhibit increased pour point temperatures. In certain embodiments, it may be desirable to offset any loss in desirable pour-point characteristics by using shorter, saturated capping materials.

The $R_4C(O)O$— of Formula II or structure $CH_3(CH_2)_yCH(CH_2)_xC(O)O$— of Formula I serve as the "base" or "base chain residue" of the estolide. Depending on the manner in which the estolide is synthesized, the base organic acid or fatty acid residue may be the only residue that remains in its free-acid form after the initial synthesis of the estolide. However, in certain embodiments, in an effort to alter or improve the properties of the estolide, the free acid may be reacted with any number of substituents. For example, it may be desirable to react the free acid estolide with alcohols, glycols, amines, or other suitable reactants to provide the corresponding ester, amide, or other reaction products. The base or base chain residue may also be referred to as tertiary or gamma (γ) chains.

The $R_3C(O)O$— of Formula II or structure $CH_3(CH_2)_yCH(CH_2)_xC(O)O$— of Formula I are linking residues that link the capping material and the base fatty-acid residue together. There may be any number of linking residues in the estolide, including when n=0 and the estolide is in its dimer form. Depending on the manner in which the estolide is prepared, a linking residue may be a fatty acid and may initially be in an unsaturated form during synthesis. In some embodiments, the estolide will be formed when a catalyst is used to produce a carbocation at the fatty acid's site of unsaturation, which is followed by nucleophilic attack on the carbocation by the carboxylic group of another fatty acid. In some embodiments, it may be desirable to have a linking fatty acid that is monounsaturated so that when the fatty acids link together, all of the sites of unsaturation are eliminated. The linking residue(s) may also be referred to as secondary or beta (β) chains.

In certain embodiments, the cap is an acetyl group, the linking residue(s) is one or more fatty acid residues, and the base chain residue is a fatty acid residue. In certain embodiments, the linking residues present in an estolide differ from one another. In certain embodiments, one or more of the linking residues differs from the base chain residue.

As noted above, in certain embodiments, suitable unsaturated fatty acids for preparing the estolides may include any mono- or polyunsaturated fatty acid. For example, monounsaturated fatty acids, along with a suitable catalyst, will form a single carbocation that allows for the addition of a second fatty acid, whereby a single link between two fatty acids is formed. Suitable monounsaturated fatty acids may include, but are not limited to, palmitoleic acid (16:1), vaccenic acid (18:1), oleic acid (18:1), eicosenoic acid (20:1), erucic acid (22:1), and nervonic acid (24:1). In addition, in certain embodiments, polyunsaturated fatty acids may be used to create estolides. Suitable polyunsaturated fatty acids may include, but are not limited to, hexadecatrienoic acid (16:3), alpha-linolenic acid (18:3), stearidonic acid (18:4), eicosatrienoic acid (20:3), eicosatetraenoic acid (20:4), eicosapentaenoic acid (20:5), heneicosapentaenoic acid (21:5), docosapentaenoic acid (22:5), docosahexaenoic acid (22:6), tetracosapentaenoic acid (24:5), tetracosahexaenoic acid (24:6), linoleic acid (18:2), gamma-linoleic acid (18:3), eicosadienoic acid (20:2), dihomo-gamma-linolenic acid (20:3), arachidonic acid (20:4), docosadienoic acid (20:2), adrenic acid (22:4), docosapentaenoic acid (22:5), tetracosatetraenoic acid (22:4), tetracosapentaenoic acid (24:5), pinolenic acid (18:3), podocarpic acid (20:3), rumenic acid (18:2), alpha-calendic acid (18:3), beta-calendic acid (18:3), jacaric acid (18:3), alpha-eleostearic acid (18:3), beta-eleostearic (18:3), catalpic acid (18:3), punicic acid (18:3), rumelenic acid (18:3), alpha-parinaric acid (18:4), beta-parinaric acid (18:4), and bosseopentaenoic acid (20:5). In certain embodiments, hydroxy fatty acids may be polymerized or homopolymerized by reacting the carboxylic acid functionality of one fatty acid with the hydroxy functionality of a second fatty acid. Exemplary hydroxyl fatty acids include, but are not limited to, ricinoleic acid, 6-hydroxystearic acid, 9,10-dihydroxystearic acid, 12-hydroxystearic acid, and 14-hydroxystearic acid.

The process for preparing the estolide compounds described herein may include the use of any natural or synthetic fatty acid source. However, it may be desirable to source the fatty acids from a renewable biological feedstock. For example, suitable starting materials of biological origin include, but are not limited to, plant fats, plant oils, plant waxes, animal fats, animal oils, animal waxes, fish fats, fish oils, fish waxes, algal oils and mixtures of two or more thereof. Other potential fatty acid sources include, but are not limited to, waste and recycled food-grade fats and oils, fats, oils, and waxes obtained by genetic engineering, fossil fuel-based materials and other sources of the materials desired.

In certain embodiments, the estolide compounds described herein may be prepared from non-naturally occurring fatty acids derived from naturally occurring feedstocks. In certain embodiments, the estolides are prepared from synthetic fatty acid reactants derived from naturally occurring feedstocks such as vegetable oils. For example, the synthetic fatty acid reactants may be prepared by cleaving fragments from larger fatty acid residues occurring in natural oils such as triglycerides using, for example, a cross-metathesis catalyst and alpha-olefin(s). The resulting truncated fatty acid residue(s) may be liberated from the glycerine backbone using any suitable hydrolytic and/or transesterification processes known to those of skill in the art. An exemplary fatty acid reactant includes 9-dodecenoic acid, which may be prepared via the cross metathesis of an oleic acid residue with 1-butene. In certain embodiments, the estolide may be prepared from fatty acids having a terminal site of unsaturation (e.g., 9-decenoic acid), which may be prepared via the cross metathesis of an oleic acid residue with ethene. Naturally occurring sources of terminally-unsaturated fatty acids may also be used (e.g., 10-undecenoic acid).

In some embodiments, the compound comprises chain residues of varying lengths. In some embodiments, x is, independently for each occurrence, an integer selected from 0 to 20, 0 to 18, 0 to 16, 0 to 14, 1 to 12, 1 to 10, 2 to 8, 6 to 8, or 4 to 6. In some embodiments, x is, independently for each occurrence, an integer selected from 7 and 8. In some embodiments, x is, independently for each occurrence, an integer selected from 0, 1, 2, 3, 4, 5, 6, 7, 8, 9, 10, 11, 12, 13, 14, 15, 16, 17, 18, 19, and 20. In certain embodiments, for at least one chain residue, x is an integer selected from 7 and 8.

In some embodiments, y is, independently for each occurrence, an integer selected from 0 to 20, 0 to 18, 0 to 16, 0 to 14, 1 to 12, 1 to 10, 2 to 8, 6 to 8, or 4 to 6. In some embodiments, y is, independently for each occurrence, an integer selected from 7 and 8. In some embodiments, y is, independently for each occurrence, an integer selected from 0, 1, 2, 3, 4, 5, 6, 7, 8, 9, 10, 11, 12, 13, 14, 15, 16, 17, 18, 19, and 20. In certain embodiments, for at least one chain residue, y is an integer selected from 7 and 8. In some embodiments, for at least one chain residue, y is an integer selected from 0 to 6, or 1 and 2. In certain embodiments, y is, independently for each occurrence, an integer selected from 1 to 6, or 1 and 2. In certain embodiments, y is 0.

In some embodiments, x+y is, independently for each chain, an integer selected from 0 to 40, 0 to 20, 10 to 20, or 12 to 18. In some embodiments, x+y is, independently for each chain, an integer selected from 13 to 15. In some embodiments, x+y is 15. In some embodiments, x+y is, independently for each chain, an integer selected from 6, 7, 8, 9, 10, 11, 12, 13, 14, 15, 16, 17, 18, 19, 20, 21, 22, 23, and 24.

In some embodiments, the estolide compound of Formula I or II may comprise any number of fatty acid residues to form an "n-mer" estolide. For example, the estolide may be in its dimer (n=0), trimer (n=1), tetramer (n=2), pentamer (n=3), hexamer (n=4), heptamer (n=5), octamer (n=6), nonamer (n=7), or decamer (n=8) form. In some embodiments, n is an integer selected from 0 to 20, 0 to 18, 0 to 16, 0 to 14, 0 to 12, 0 to 10, 0 to 8, or 0 to 6. In some embodiments, n is an integer selected from 0 to 4. In some embodiments, n is 0 or greater than 0. In some embodiments, n is 1, wherein said at least one compound of Formula I or II comprises the trimer. In some embodiments, n is greater than 1. In some embodiments, n is an integer selected from 0, 1, 2, 3, 4, 5, 6, 7, 8, 9, 10, 11, 12, 13, 14, 15, 16, 17, 18, 19, and 20.

In some embodiments, $R_1$ of Formula I or II is an optionally substituted alkyl that is saturated or unsaturated, and branched or unbranched. In some embodiments, the alkyl group is a $C_1$ to $C_{40}$ alkyl, $C_1$ to $C_{22}$ alkyl or $C_1$ to $C_{18}$ alkyl. In some embodiments, the alkyl group is selected from $C_7$ to $C_{17}$ alkyl. In some embodiments, $R_1$ is selected from $C_7$ alkyl, $C_9$ alkyl, $C_{11}$ alkyl, $C_{13}$ alkyl, $C_{15}$ alkyl, and $C_{17}$ alkyl. In some embodiments, $R_1$ is selected from $C_{13}$ to $C_{17}$ alkyl, such as from $C_{13}$ alkyl, $C_{15}$ alkyl, and $C_{17}$ alkyl. In some embodiments, $R_1$ is a $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, or $C_{22}$ alkyl.

In some embodiments, $R_2$ of Formula I or II is an optionally substituted alkyl that is saturated or unsaturated, and branched or unbranched. In some embodiments, the alkyl group is a $C_1$ to $C_{40}$ alkyl, $C_1$ to $C_{22}$ alkyl or $C_1$ to $C_{18}$ alkyl. In some embodiments, the alkyl group is selected from $C_7$ to $C_{17}$ alkyl. In some embodiments, $R_2$ is selected from $C_7$ alkyl, $C_9$ alkyl, $C_{11}$ alkyl, $C_{13}$ alkyl, $C_{15}$ alkyl, and $C_{17}$ alkyl. In some embodiments, $R_2$ is selected from $C_{13}$ to $C_{17}$ alkyl, such as from $C_{13}$ alkyl, $C_{15}$ alkyl, and $C_{17}$ alkyl. In some embodiments, $R_2$ is a $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, or $C_{22}$ alkyl.

In some embodiments, $R_3$ is an optionally substituted alkyl that is saturated or unsaturated, and branched or unbranched. In some embodiments, the alkyl group is a $C_1$ to $C_{40}$ alkyl, $C_1$ to $C_{22}$ alkyl or $C_1$ to $C_{18}$ alkyl. In some embodiments, the alkyl group is selected from $C_7$ to $C_{17}$ alkyl. In some embodiments, $R_3$ is selected from $C_7$ alkyl, $C_9$ alkyl, $C_{11}$ alkyl, $C_{13}$ alkyl, $C_{15}$ alkyl, and $C_{17}$ alkyl. In some embodiments, $R_3$ is selected from $C_{13}$ to $C_{17}$ alkyl, such as from $C_{13}$ alkyl, $C_{15}$ alkyl, and $C_{17}$ alkyl. In some embodiments, $R_3$ is a $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, or $C_{22}$ alkyl. In certain embodiments, $R_3$ is selected from $C_9$ and $C_{10}$.

In some embodiments, $R_4$ is an optionally substituted alkyl that is saturated or unsaturated, and branched or unbranched. In some embodiments, the alkyl group is a $C_1$ to $C_{40}$ alkyl, $C_1$ to $C_{22}$ alkyl or $C_1$ to $C_{18}$ alkyl. In some embodiments, the alkyl group is selected from $C_7$ to $C_{17}$ alkyl. In some embodiments, $R_4$ is selected from $C_7$ alkyl, $C_9$ alkyl, $C_{11}$ alkyl, $C_{13}$ alkyl, $C_{15}$ alkyl, and $C_{17}$ alkyl. In some embodiments, $R_4$ is selected from $C_{13}$ to $C_{17}$ alkyl, such as from $C_{13}$ alkyl, $C_{15}$ alkyl, and $C_{17}$ alkyl. In some embodiments, $R_4$ is a $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, or $C_{22}$ alkyl. In certain embodiments, $R_4$ is selected from $C_9$ and $C_{10}$.

As noted above, in certain embodiments, it may be possible to manipulate one or more of the estolides' properties by altering the length of $R_1$ and/or its degree of saturation. However, in certain embodiments, the level of substitution on $R_1$ may also be altered to change or even improve the estolides' properties. Without being bound to any particular theory, in certain embodiments, it is believed that the presence of polar substituents on $R_1$, such as one or more hydroxy groups, may increase the viscosity of the estolide, while increasing pour point. Accordingly, in some embodiments, $R_1$ will be unsubstituted or optionally substituted with a group that is not hydroxyl.

In some embodiments, the estolide is in its free-acid form, wherein $R_2$ of Formula I or II is hydrogen. In some embodiments, $R_2$ is selected from optionally substituted alkyl that is saturated or unsaturated, and branched or unbranched. In certain embodiments, the $R_2$ residue may comprise any desired alkyl group, such as those derived from esterification of the estolide with the alcohols identified in the examples herein. In some embodiments, the alkyl group is selected from $C_1$ to $C_{40}$, $C_1$ to $C_{22}$, $C_3$ to $C_{20}$, $C_1$ to $C_{18}$, or $C_6$ to $C_{12}$ alkyl. In some embodiments, $R_2$ may be selected from $C_3$ alkyl, $C_4$ alkyl, $C_8$ alkyl, $C_{12}$ alkyl, $C_{16}$ alkyl, $C_{18}$ alkyl, and $C_{20}$ alkyl. For example, in certain embodiments, $R_2$ may be branched, such as isopropyl, isobutyl, or 2-ethylhexyl. In some embodiments, $R_2$ may be a larger alkyl group, branched or unbranched, comprising $C_{12}$ alkyl, $C_{16}$ alkyl, $C_{18}$ alkyl, or $C_{20}$ alkyl. Such groups at the $R_2$ position may be derived from esterification of the free-acid estolide using the Jarcoff line of alcohols marketed by Jarchem Industries, Inc. of Newark, N.J., including Jarcoff I-18CG, 1-20, 1-12, 1-16, I-18T, and 85BJ. In some cases, $R_2$ may be sourced from certain alcohols to provide branched alkyls such as isostearyl and isopalmityl. It should be understood that such isopalmityl and isostearyl akyl groups may cover any branched variation of $C_{16}$ and $C_{18}$, respectively. For example, the estolides described herein may comprise highly-branched isopalmityl or isostearyl groups at the $R_2$ position, derived from the Fineoxocol® line of isopalmityl and isostearyl alcohols marketed by Nissan Chemical America Corporation of Houston, Tex., including Fineoxocol® 180, 180N, and 1600. Without being bound to any particular theory, in certain embodiments, large, highly-branched alkyl groups (e.g., isopalmityl and isostearyl) at the $R_2$ position of the estolides can provide at least one way to increase an estolide-containing composition's viscosity, while substantially retaining or even reducing its pour point.

In some embodiments, the compounds described herein may comprise a mixture of two or more estolide compounds of Formula I or II. It is possible to characterize the chemical makeup of an estolide, a mixture of estolides, or a composition comprising estolides, by using the compound's, mixture's, or composition's measured estolide number (EN) of compound or composition. The EN represents the average number of fatty acids added to the base fatty acid. The EN also represents the average number of estolide linkages per molecule:

$$EN=n+1$$

wherein n is the number of secondary (β) fatty acids. Accordingly, a single estolide compound will have an EN that is a whole number, for example for dimers, trimers, and tetramers:

dimer EN=1 trimer EN=2 tetramer EN=3

However, a composition comprising two or more estolide compounds may have an EN that is a whole number or a fraction of a whole number. For example, a composition having a 1:1 molar ratio of dimer and trimer would have an EN of 1.5, while a composition having a 1:1 molar ratio of tetramer and trimer would have an EN of 2.5.

In some embodiments, the compositions may comprise a mixture of two or more estolides having an EN that is an integer or fraction of an integer that is greater than 4.5, or even 5.0. In some embodiments, the EN may be an integer or fraction of an integer selected from about 1.0 to about 5.0. In some embodiments, the EN is an integer or fraction of an integer selected from 1.2 to about 4.5. In some embodiments, the EN is selected from a value greater than 1.0, 1.2, 1.4, 1.6, 1.8, 2.0, 2.2, 2.4, 2.6, 2.8, 3.0, 3.2, 3.4, 3.6, 3.8, 4.0, 4.2, 4.4, 4.6, 4.8, 5.0, 5.2, 5.4, 5.6 and 5.8. In some embodiments, the EN is selected from a value less than 1.2, 1.4, 1.6, 1.8, 2.0, 2.2, 2.4, 2.6, 2.8, 3.0, 3.2, 3.4, 3.6, 3.8, 4.0, 4.2, 4.4, 4.6, 4.8, and 5.0, 5.2, 5.4, 5.6, 5.8, and 6.0. In some embodiments, the EN is selected from 1, 1.2, 1.4, 1.6, 1.8, 2.0, 2.2, 2.4, 2.6, 2.8, 3.0, 3.2, 3.4, 3.6, 3.8, 4.0, 4.2, 4.4, 4.6, 4.8, 5.0, 5.2, 5.4, 5.6, 5.8, and 6.0.

As noted above, it should be understood that the chains of the estolide compounds may be independently optionally substituted, wherein one or more hydrogens are removed and replaced with one or more of the substituents identified herein. Similarly, two or more of the hydrogen residues may be removed to provide one or more sites of unsaturation, such as a cis or trans double bond. Further, the chains may optionally comprise branched hydrocarbon residues. For example, in some embodiments the estolides described herein may comprise at least one compound of Formula II:

Formula II

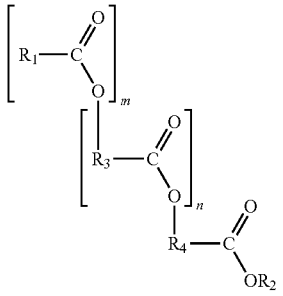

wherein m is an integer equal to or greater than 1;

n is an integer equal to or greater than 0;

$R_1$, independently for each occurrence, is an optionally substituted alkyl that is saturated or unsaturated, and branched or unbranched;

$R_2$ is selected from hydrogen and optionally substituted alkyl that is saturated or unsaturated, and branched or unbranched; and $R_3$ and $R_4$, independently for each occurrence, are selected from optionally substituted alkyl that is saturated or unsaturated, and branched or unbranched.

In certain embodiments, m is 1. In some embodiments, m is an integer selected from 2, 3, 4, and 5. In some embodiments, n is an integer selected from 1, 2, 3, 4, 5, 6, 7, 8, 9, 10, 11, and 12. In some embodiments, one or more $R_3$ differs from one or more other $R_3$ in a compound of Formula II. In some embodiments, one or more $R_3$ differs from $R_4$ in a compound of Formula II. In some embodiments, if the compounds of Formula II are prepared from one or more polyunsaturated fatty acids, it is possible that one or more of $R_3$ and $R_4$ will have one or more sites of unsaturation. In some embodiments, if the compounds of Formula II are prepared from one or more branched fatty acids, it is possible that one or more of $R_3$ and $R_4$ will be branched.

In some embodiments, $R_3$ and $R_4$ can be $CH_3(CH_2)_yCH(CH_2)_x$—, where x is, independently for each occurrence, an integer selected from 0, 1, 2, 3, 4, 5, 6, 7, 8, 9, 10, 11, 12, 13, 14, 15, 16, 17, 18, 19, and 20, and y is, independently for each occurrence, an integer selected from 0, 1, 2, 3, 4, 5, 6, 7, 8, 9, 10, 11, 12, 13, 14, 15, 16, 17, 18, 19, and 20. Where both $R_3$ and $R_4$ are $CH_3(CH_2)_yCH(CH_2)_x$—, the compounds may be compounds according to Formula I and III.

Without being bound to any particular theory, in certain embodiments, altering the EN produces estolide-containing compositions having desired viscometric properties while substantially retaining or even reducing pour point. For example, in some embodiments the estolides exhibit a decreased pour point upon increasing the EN value. Accordingly, in certain embodiments, a method is provided for retaining or decreasing the pour point of an estolide base oil by increasing the EN of the base oil, or a method is provided for retaining or decreasing the pour point of a composition comprising an estolide base oil by increasing the EN of the base oil. In some embodiments, the method comprises: selecting an estolide base oil having an initial EN and an initial pour point; and removing at least a portion of the base oil, said portion exhibiting an EN that is less than the initial EN of the base oil, wherein the resulting estolide base oil exhibits an EN that is greater than the initial EN of the base oil, and a pour point that is equal to or lower than the initial pour point of the base oil. In some embodiments, the selected estolide base oil is prepared by oligomerizing at least one first unsaturated fatty acid with at least one second unsaturated fatty acid and/or saturated fatty acid. In some embodiments, the removing at least a portion of the base oil or a composition comprising two or more estolide compounds is accomplished by use of at least one of distillation, chromatography, membrane separation, phase separation, affinity separation, and solvent extraction. In some embodiments, the distillation takes place at a temperature and/or pressure that is suitable to separate the estolide base oil or a composition comprising two or more estolide compounds into different "cuts" that individually exhibit different EN values. In some embodiments, this may be accomplished by subjecting the base oil or a composition comprising two or more estolide compounds to a temperature of at least about 250° C. and an absolute pressure of no greater than about 25 microns. In some embodiments, the distillation takes place at a temperature range of about 250° C. to about 310° C. and an absolute pressure range of about 10 microns to about 25 microns.

In some embodiments, estolide compounds and compositions exhibit an EN that is greater than or equal to 1, such as an integer or fraction of an integer selected from about 1.0 to about 2.0. In some embodiments, the EN is an integer or fraction of an integer selected from about 1.0 to about 1.6. In some embodiments, the EN is a fraction of an integer selected from about 1.1 to about 1.5. In some embodiments, the EN is selected from a value greater than 1.0, 1.1, 1.2, 1.3, 1.4, 1.5, 1.6, 1.7, 1.8, and 1.9. In some embodiments, the EN is selected from a value less than 1.1, 1.2, 1.3, 1.4, 1.5, 1.6, 1.7, 1.8, 1.9, and 2.0.

In some embodiments, the EN is greater than or equal to 1.5, such as an integer or fraction of an integer selected from about 1.8 to about 2.8. In some embodiments, the EN is an integer or fraction of an integer selected from about 2.0 to about 2.6. In some embodiments, the EN is a fraction of an integer selected from about 2.1 to about 2.5. In some embodiments, the EN is selected from a value greater than 1.8, 1.9, 2.0, 2.1, 2.2, 2.3, 2.4, 2.5, 2.6, and 2.7. In some embodiments, the EN is selected from a value less than 1.9, 2.0, 2.1, 2.2, 2.3, 2.4, 2.5, 2.6, 2.7, and 2.8. In some embodiments, the EN is about 1.8, 2.0, 2.2, 2.4, 2.6, or 2.8.

In some embodiments, the EN is greater than or equal to about 4, such as an integer or fraction of an integer selected from about 4.0 to about 5.0. In some embodiments, the EN is a fraction of an integer selected from about 4.2 to about 4.8. In some embodiments, the EN is a fraction of an integer selected from about 4.3 to about 4.7. In some embodiments, the EN is selected from a value greater than 4.0, 4.1, 4.2, 4.3, 4.4, 4.5, 4.6, 4.7, 4.8, and 4.9. In some embodiments, the EN is selected from a value less than 4.1, 4.2, 4.3, 4.4, 4.5, 4.6, 4.7, 4.8, 4.9, and 5.0. In some embodiments, the EN is about 4.0, 4.2, 4.4, 4.6, 4.8, or 5.0.

In some embodiments, the EN is greater than or equal to about 5, such as an integer or fraction of an integer selected from about 5.0 to about 6.0. In some embodiments, the EN is a fraction of an integer selected from about 5.2 to about 5.8. In some embodiments, the EN is a fraction of an integer selected from about 5.3 to about 5.7. In some embodiments, the EN is selected from a value greater than 5.0, 5.1, 5.2, 5.3, 5.4, 5.5, 5.6, 5.7, 5.8, and 5.9. In some embodiments, the EN is selected from a value less than 5.1, 5.2, 5.3, 5.4, 5.5, 5.6, 5.7, 5.8, 5.9, and 6.0. In some embodiments, the EN is about 5.0, 5.2, 5.4, 5.4, 5.6, 5.8, or 6.0.

In some embodiments, the EN is greater than or equal to 1, such as an integer or fraction of an integer selected from about 1.0 to about 2.0. In some embodiments, the EN is a fraction of an integer selected from about 1.1 to about 1.7. In some embodiments, the EN is a fraction of an integer selected from about 1.1 to about 1.5. In some embodiments, the EN is selected from a value greater than 1.0, 1.1, 1.2, 1.3, 1.4, 1.5, 1.6, 1.7, 1.8, or 1.9. In some embodiments, the EN is selected from a value less than 1.2, 1.3, 1.4, 1.5, 1.6, 1.7, 1.8, 1.9, or 2.0. In some embodiments, the EN is about 1.0, 1.2, 1.4, 1.6, 1.8, or 2.0. In some embodiments, the EN is greater than or equal to 1, such as an integer or fraction of an integer selected from about 1.2 to about 2.2. In some embodiments, the EN is an integer or fraction of an integer selected from about 1.4 to about 2.0. In some embodiments, the EN is a fraction of an integer selected from about 1.5 to about 1.9. In some embodiments, the EN is selected from a value greater than 1.0, 1.1. 1.2, 1.3, 1.4, 1.5, 1.6, 1.7, 1.8, 1.9, 2.0, and 2.1. In some embodiments, the EN is selected from a value less than 1.2, 1.3, 1.4, 1.5, 1.6, 1.7, 1.8, 1.9, 2.0, 2.1, and 2.2. In some embodiments, the EN is about 1.0, 1.2, 1.4, 1.6, 1.8, 2.0, or 2.2.

In some embodiments, the EN is greater than or equal to 2, such as an integer or fraction of an integer selected from about 2.8 to about 3.8. In some embodiments, the EN is an integer or fraction of an integer selected from about 2.9 to about 3.5. In some embodiments, the EN is an integer or fraction of an integer selected from about 3.0 to about 3.4. In some embodiments, the EN is selected from a value greater than 2.0, 2.1, 2.2., 2.4, 2.5, 2.6, 2.7, 2.8, 2.9, 3.0, 3.1, 3.4, 3.5, 3.6, and 3.7. In some embodiments, the EN is selected from a value less than 2.2, 2.3, 2.4, 2.5, 2.6, 2.7, 2.8, 2.9, 3.0, 3.1, 3.2, 3.3, 3.4, 3.5, 3.6, 3.7, and 3.8. In some embodiments, the EN is about 2.0, 2.2, 2.4, 2.6, 2.8, 3.0, 3.2, 3.4, 3.6, or 3.8.

Typically, base stocks and estolide-containing compositions exhibit certain lubricity, viscosity, and/or pour point characteristics. For example, in certain embodiments, the base oils, compounds, and compositions may exhibit viscosities that range from about 10 cSt to about 250 cSt at 40° C., and/or about 3 cSt to about 30 cSt at 100° C. In some embodiments, the base oils, compounds, and compositions may exhibit viscosities within a range from about 50 cSt to about 150 cSt at 40° C., and/or about 10 cSt to about 20 cSt at 100° C.

In some embodiments, the estolide compounds and compositions may exhibit viscosities less than about 55 cSt at 40° C. or less than about 45 cSt at 40° C., and/or less than about 12 cSt at 100° C. or less than about 10 cSt at 100° C. In some embodiments, the estolide compounds and compositions may exhibit viscosities within a range from about 25 cSt to about 55 cSt at 40° C., and/or about 5 cSt to about 11 cSt at 100° C. In some embodiments, the estolide compounds and compositions may exhibit viscosities within a range from about 35 cSt to about 45 cSt at 40° C., and/or about 6 cSt to about 10 cSt at 100° C. In some embodiments, the estolide compounds and compositions may exhibit viscosities within a range from about 38 cSt to about 43 cSt at 40° C., and/or about 7 cSt to about 9 cSt at 100° C.

In some embodiments, the estolide compounds and compositions may exhibit viscosities less than about 120 cSt at 40° C. or less than about 100 cSt at 40° C., and/or less than about 18 cSt at 100° C. or less than about 17 cSt at 100° C. In some embodiments, the estolide compounds and compositions may exhibit a viscosity within a range from about 70 cSt to about 120 cSt at 40° C., and/or about 12 cSt to about 18 cSt at 100° C. In some embodiments, the estolide compounds and compositions may exhibit viscosities within a range from about 80 cSt to about 100 cSt at 40° C., and/or about 13 cSt to about 17 cSt at 100° C. In some embodiments, the estolide compounds and compositions may exhibit viscosities within a range from about 85 cSt to about 95 cSt at 40° C., and/or about 14 cSt to about 16 cSt at 100° C.

In some embodiments, the estolide compounds and compositions may exhibit viscosities greater than about 180 cSt at 40° C. or greater than about 200 cSt at 40° C., and/or greater than about 20 cSt at 100° C. or greater than about 25 cSt at 100° C. In some embodiments, the estolide compounds and compositions may exhibit a viscosity within a range from about 180 cSt to about 230 cSt at 40° C., and/or about 25 cSt to about 31 cSt at 100° C. In some embodiments, the estolide compounds and compositions may exhibit viscosities within a range from about 200 cSt to about 250 cSt at 40° C., and/or about 25 cSt to about 35 cSt at 100° C. In some embodiments, the estolide compounds and compositions may exhibit viscosities within a range from about 210 cSt to about 230 cSt at 40° C., and/or about 28 cSt to about 33 cSt at 100° C. In some embodiments, the estolide compounds and compositions may exhibit viscosities within a range from about 200 cSt to about 220 cSt at 40° C., and/or about 26 cSt to about 30 cSt at 100° C. In some embodiments, the estolide compounds and compositions may exhibit viscosities within a range from about 205 cSt to about 215 cSt at 40° C., and/or about 27 cSt to about 29 cSt at 100° C.

In some embodiments, the estolide compounds and compositions may exhibit viscosities less than about 45 cSt at 40° C. or less than about 38 cSt at 40° C., and/or less than about 10 cSt at 100° C. or less than about 9 cSt at 100° C. In some embodiments, the estolide compounds and compositions may exhibit a viscosity within a range from about 20 cSt to about 45 cSt at 40° C., and/or about 4 cSt to about 10 cSt at 100° C. In some embodiments, the estolide compounds and compositions may exhibit viscosities within a range from about 28 cSt to about 38 cSt at 40° C., and/or about 5 cSt to about 9 cSt at 100° C. In some embodiments, the estolide compounds and compositions may exhibit viscosities within a range from about 30 cSt to about 35 cSt at 40° C., and/or about 6 cSt to about 8 cSt at 100° C.

In some embodiments, the estolide compounds and compositions may exhibit viscosities less than about 80 cSt at 40° C. or less than about 70 cSt at 40° C., and/or less than about 14 cSt at 100° C. or less than about 13 cSt at 100° C. In some embodiments, the estolide compounds and compositions may exhibit a viscosity within a range from about 50 cSt to about 80 cSt at 40° C., and/or about 8 cSt to about 14 cSt at 100° C. In some embodiments, the estolide compounds and compositions may exhibit viscosities within a range from about 60 cSt to about 70 cSt at 40° C., and/or about 9 cSt to about 13 cSt at 100° C. In some embodiments, the estolide compounds and compositions may exhibit viscosities within a range from about 63 cSt to about 68 cSt at 40° C., and/or about 10 cSt to about 12 cSt at 100° C.

In some embodiments, the estolide compounds and compositions may exhibit viscosities greater than about 120 cSt at 40° C. or greater than about 130 cSt at 40° C., and/or greater than about 15 cSt at 100° C. or greater than about 18 cSt at 100° C. In some embodiments, the estolide compounds and compositions may exhibit a viscosity within a range from about 120 cSt to about 150 cSt at 40° C., and/or about 16 cSt to about 24 cSt at 100° C. In some embodiments, the estolide compounds and compositions may exhibit viscosities within a range from about 130 cSt to about 160 cSt at 40° C., and/or about 17 cSt to about 28 cSt at 100° C. In some embodiments, the estolide compounds and compositions may exhibit viscosities within a range from about 130 cSt to about 145 cSt at 40° C., and/or about 17 cSt to about 23 cSt at 100° C. In some embodiments, the estolide compounds and compositions may exhibit viscosities within a range from about 135 cSt to about 140 cSt at 40° C., and/or about 19 cSt to about 21 cSt at 100° C. In some embodiments, the estolide compounds and compositions may exhibit viscosities of about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 55, 60, 65, 70, 75, 80, 85, 90, 95, 100, 110, 120, 130, 140, 150, 160, 170, 180, 190, 200, 210, 220, 230, 240, 250, 260, 270, 280, 290, 300, 350, or 400 cSt. at 40° C. In some embodiments, the estolide compounds and compositions may exhibit viscosities of about 1, 2, 3, 4, 5, 6, 7, 8, 9, 10, 11, 12, 13, 14, 15, 16, 17, 18, 19, 20, 21, 22, 23, 24, 25, 26, 27, 28, 29, and 30 cSt at 100° C.

In some embodiments, the estolide compounds and compositions may exhibit viscosities less than about 200, 250, 300, 350, 400, 450, 500, or 550 cSt at 0° C. In some embodiments, the estolide compounds and compositions may exhibit a viscosity within a range from about 200 cSt to about 250 cSt at 0° C. In some embodiments, the estolide compounds and compositions may exhibit a viscosity within a range from about 250 cSt to about 300 cSt at 0° C. In some embodiments, the estolide compounds and compositions may exhibit a viscosity within a range from about 300 cSt to about 350 cSt at 0° C. In some embodiments, the estolide compounds and compositions may exhibit a viscosity within a range from about 350 cSt to about 400 cSt at 0° C. In some embodiments, the estolide compounds and compositions may exhibit a viscosity within a range from about 400 cSt to about 450 cSt at 0° C. In some embodiments, the estolide compounds and compositions may exhibit a viscosity within a range from about 450 cSt to about 500 cSt at 0° C. In some embodiments, the estolide compounds and compositions may exhibit a viscosity within a range from about 500 cSt to about 550 cSt at 0° C. In some embodiments, the estolide compounds and compositions may exhibit viscosities of about 100, 125, 150, 175, 200, 225, 250, 275, 300, 325, 350, 375, 400, 425, 450, 475, 500, 525, or 550 cSt at 0° C.

In some embodiments, estolide compounds and compositions may exhibit desirable low-temperature pour point properties. In some embodiments, the estolide compounds and compositions may exhibit a pour point lower than about −20° C., about −25° C., about −35° C., −40° C., or even about −50° C. In some embodiments, the estolide compounds and compositions have a pour point of about −25° C. to about −45° C. In some embodiments, the pour point falls within a range of about −30° C. to about −40° C., about −34° C. to about −38° C., about −30° C. to about −45° C., −35° C. to about −45° C., 34° C. to about −42° C., about −38° C. to about −42° C., or about 36° C. to about −40° C. In some embodiments, the pour point falls within the range of about −27° C. to about −37° C., or about −30° C. to about −34° C. In some embodiments, the pour point falls within the range of about −25° C. to about −35° C., or about −28° C. to about −32° C. In some embodiments, the pour point falls within the range of about −28° C. to about −38° C., or about −31° C. to about −35° C. In some embodiments, the pour point falls within the range of about −31° C. to about −41° C., or about -34° C. to about −38° C. In some embodiments, the pour point falls within the range of about −40° C. to about −50° C., or about −42° C. to about −48° C. In some embodiments, the pour point falls within the range of about −50° C. to about −60° C., or about −52° C. to about −58° C. In some embodiments, the upper bound of the pour point is less than about −35° C., about −36° C., about −37° C., about −38° C., about −39° C., about −40° C., about −41° C., about −42° C., about −43° C., about −44° C., or about −45° C. In some embodiments, the lower bound of the pour point is greater than about −70° C., about −69° C., about −68° C., about −67° C., about −66° C., about −65° C., about −64° C., about −63° C., about −62° C., about −61° C., about −60° C., about −59° C., about −58° C., about −57° C., about −56° C., −55° C., about −54° C., about −53° C., about −52° C., −51, about −50° C., about −49° C., about −48° C., about −47° C., about −46° C., or about −45° C.

In addition, in certain embodiments, the estolides may exhibit decreased Iodine Values (IV) when compared to estolides prepared by other methods. IV is a measure of the degree of total unsaturation of an oil, and is determined by measuring the amount of iodine per gram of estolide (cg/g). In certain instances, oils having a higher degree of unsaturation may be more susceptible to creating corrosiveness and deposits, and may exhibit lower levels of oxidative stability. Compounds having a higher degree of unsaturation will have more points of unsaturation for iodine to react with, resulting in a higher IV. Thus, in certain embodiments, it may be desirable to reduce the IV of estolides in an effort to increase the oil's oxidative stability, while also decreasing harmful deposits and the corrosiveness of the oil.

In some embodiments, estolide compounds and compositions described herein have an IV of less than about 40 cg/g or less than about 35 cg/g. In some embodiments, estolides have an IV of less than about 30 cg/g, less than about 25 cg/g, less than about 20 cg/g, less than about 15 cg/g, less than about 10 cg/g, or less than about 5 cg/g. In some embodiments, estolides have an IV of about 0 cg/g. The IV of a composition may be reduced by decreasing the estolide's degree of unsaturation. This may be accomplished by, for example, by increasing the amount of saturated capping materials relative to unsaturated capping materials when synthesizing the estolides. Alternatively, in certain embodiments, IV may be reduced by hydrogenating estolides having unsaturated caps.

In some embodiments, the estolide compounds described herein may be useful as base oils in two-cycle lubricating compositions. In some embodiments, the composition comprises one or more estolide compounds and a lubricant additive package. Exemplary additive packages may include one or more components selected from solvents, viscosity index improvers, corrosion inhibitors, oxidation inhibitors, dispersants, lube oil flow improvers, detergents and rust inhibitors, pour point depressants, anti-foaming agents, antiwear agents, seal swellants, and friction modifiers.

In some cases, dissolution of the additive into the base stock may be facilitated by solvents and/or by mixing accompanied with mild heating. In some embodiments, the two-cycle lubricants described herein can employ greater than 0 wt. % up to about 95 wt. % of the additive package, with the remainder being estolide base stock. In some embodiments, the estolide base oil may comprise from about 1 to about 95 wt. %, about 10 to about 80 wt. %, about 25 to about 75 wt. %, about 30 to about 60 wt. %, or about 40 to about 50 wt. % of the two-cycle lubricant formulation.

Unless otherwise indicated, all of the weight percentages expressed herein is based on the content of the formulation, which will be the sum of the additive plus the weight of the base oil.

In certain embodiments, the two-cycle lubricating composition comprises at least one corrosion inhibitor. Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, optionally in the presence of an alkylated phenol or of an alkylphenol thioester, and also optionally in the presence of carbon dioxide.

In certain embodiments, the two-cycle lubricating composition comprises at least one antioxidant. Oxidation inhibitors, or antioxidants, reduce the tendency of base oils to deteriorate in service, which deterioration can be evidenced by the products of oxidation such as sludge and varnish-like deposits on the metal surfaces, and by increases in viscosity. Such oxidation inhibitors include alkaline earth metal salts of alkyl-phenolthioesters having, for example, $C_5$ to $C_{12}$ alkyl side chains, such as calcium nonylphenol sulfide, barium t-octylphenol sulfide, as well as phosphosulfurized or sulfurized hydrocarbons Also included are oil soluble antioxidant copper compounds such as copper salts of $C_{10}$-$C_{18}$ oil soluble fatty acids. In certain embodiments, the at least one antioxidant is selected from phenolic antioxidants, amine antioxidants, and organometallic antioxidants. In certain embodiments, the at least one antioxidant is a phenolic antioxidant. In certain embodiments, the at least one antioxidant is a hindered phenolic antioxidant. In certain embodiments, the at least one antioxidant is an amine antioxidant, such as a diarylamine, benzylamine, or polyamine. In certain embodiments, the at least one antioxidant is a diarylamine antioxidant, such as an alkylated diphenylamine antioxidant. In certain embodiments, the at least one antioxidant is a phenyl-α-naphthylamine or an alkylated phenyl-α-naphthylamine. In certain embodiments, the at least one antioxidant comprises an antioxidant package. In certain embodiments, the antioxidant package comprises one or more phenolic antioxidants and one or more amine antioxidants, such as a combination of a hindered phenolic antioxidant and an alkylated diphenylamine antioxidant. In some embodiments, the antioxidant may be present in amounts of about 0% to about 10% by weight, or about 0% to about 5% by weight of the two-cycle lubricant formulation. In some embodiments, the antioxidant may be present in amounts of about 1% to about 2% by weight of the two-cycle lubricating composition.

In certain embodiments, the two-cycle lubricating composition comprises at least one friction modifier. Representative examples of suitable friction modifiers may include fatty acid esters and amides; molybdenum complexes, such as those derived from polyisobutenyl succinic anhydride and one or more amino alkanols; glycerol esters of dimerized fatty acids; alkyl phosphonic acids and salts thereof, such as the reaction product of a phosphonate with an oleamide; succinic anhydrides, succinamic acids and succinimides, such as S-carboxyalkylene and hydrocarbyl variants thereof; N-(hydroxyalkyl)succinamic acids and succinimides, and alkenyl variants thereof; di-(alkyl)phosphites and epoxides; and phosphosulfurized N-(hydroxyalkyl)alkenyl succinimides, including alkylene oxide adducts thereof. Suitable friction modifiers may also include succinate esters, or metal salts thereof, of hydrocarbyl substituted succinic acids or anhydrides and thiobis-alkanols.

In certain embodiments, the two-cycle lubricating composition comprises at least one dispersant. Dispersants may be used to maintain oil insolubles resulting from oxidation during use, which may be in suspension in the fluid, thus preventing sludge flocculation and precipitation or deposition on metal parts. Suitable dispersants may include high molecular weight alkyl succinimides, the reaction product of oil-soluble polyisobutylene succinic anhydrides with alkylated amines such as tetraethylene pentamine and borated salts thereof.

Dispersants of the ashless type can also be used in the formulations described herein. An exemplary ashless dispersant is a derivatized hydrocarbon composition which is mixed with at least one of an amine and/or alcohol, such as a polyol and an aminoalcohol. Derivatized hydrocarbon dispersants include the product of reacting (1) a functionalized hydrocarbon of less than 500 Mn (number average molecular weight) wherein functionalization comprises at least one group of the formula —CO—Y—$R_3$, wherein Y is O or S; $R_3$ is H, hydrocarbyl, aryl, substituted aryl or substituted hydrocarbyl and wherein at least 50 mole % of the functional groups are attached to a tertiary carbon atom; and (2) a nucleophilic reactant; wherein at least about 80% of the functional groups originally present in the functionalized hydrocarbon are derivatized.

In certain embodiments, the two-cycle lubricating composition comprises at least one pour-point depressant. Pour-point depressants, also known as lube oil flow improvers, can lower the temperature at which the fluid will flow. Exemplary additives include $C_8$-$C_{18}$ dialkyl fumarate vinyl acetate copolymers, polymethacrylates and wax naphthalene, which may be included in amounts such as about 0.1 to about 1.0 wt. %.

In certain embodiments, the two-cycle lubricating composition comprises at least one foam control (antifoam) agent. Foam control can also be provided by an anti-foamant of the polysiloxane type, such as silicone oil and polydimethyl siloxane.

In certain embodiments, the two-cycle lubricating composition comprises at least one anti-wear agent. Anti-wear agents may reduce wear of metal parts, and may include materials such as zinc dialkyldithiophosphate and zinc diaryl diphosphate.

In certain embodiments, the two-cycle lubricating composition comprises at least one detergent and/or metal rust inhibitor. Detergents and metal rust inhibitors include the metal salts of sulfonic acids, alkylphenols, sulfurized alkylphenols, alkyl salicylates, naphthenates and/or oil soluble mono- and dicarboxylic acids. Neutral or highly basic metal salts such as highly basic alkaline earth metal sulfonates (such as calcium and magnesium salts) may be used as such detergents. In certain embodiments, the detergent comprises a calcium detergent, such as a calcium sulfonate, a calcium phenate, or a calcium salicylate. In certain embodiments, the detergent is an overbased detergent, such as an overbased calcium detergent. In certain embodiments, the detergent has a total base number of about 25 to about 600, such as about 30 to about 60, about 40 to about 80, about 100 to about 500, or about 150 to about 450, as expressed in mg KOH/g of the detergent composition. In certain embodiments, the detergent is an alkylphenol sulfide, such as nonylphenol sulfide. Exemplary materials may be prepared by reacting an alkylphenol with commercial sulfur dichlorides. Suitable alkylphenol sulfides can also be prepared by reacting alkylphenols with elemental sulfur. Other suitable detergents may include neutral and basic salts of phenols, which may also be known as phenates. Exemplary phenates include those substituted with one or more alkyl groups, such as a $C_4$ to $C_{40}$ alkyl group. Exemplary detergent additives may include, for example, "S911" sold by Infineum USA of Linden, N.J. In some embodiments, the two-cycle lubricating composition may comprise from about 0 wt. % to about 20 wt. %, about 0 wt. % to about 10 wt. %, about 1 wt. % to about 8 wt. %, about 3 wt. % to about 6 wt. %, or about 4 wt. % to about 5 wt. % of the at least one detergent.

In certain embodiments, the two-cycle lubricating composition comprises at least one viscosity modifier. Viscosity modifiers may impart high and low temperature operability to the lubricating oil and permit it to remain shear stable at elevated temperatures and also exhibit acceptable viscosity or fluidity at low temperatures. Exemplary viscosity modifiers may include high molecular weight hydrocarbon polymers, including polyesters. The viscosity modifiers may also be derivatized to include other properties or functions, such as the addition of dispersancy properties. Representative examples of suitable viscosity modifiers may include any of those known in the art, such as polybutenes, polyisobutylenes (PIB), copolymers of ethylene and propylene, polymethacrylates, methacrylate copolymers, copolymers of an unsaturated dicarboxylic acid and vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

In some embodiments, the two-cycle lubricant compositions comprise at least one polybutene polymer. In some embodiments, the polybutene may comprise a mixture of poly-n-butenes and polyisobutylene, which may result from the polymerization of $C_4$ olefins and a number average molecular weight of about 300 to 1500, such as about 400 to 1300. In some embodiments, the polybutene and/or polyisobutylene may have a number average molecular weight of about 950, which may be measured by gel permeation chromatography. Polymers composed of 100% polyisobutylene or 100% poly-n-butene should be understood to fall within the scope of this disclosure and within the meaning of the term "a polybutene polymer". An exemplary polyisobutylene includes "PIB S 1054" which has number average molecular weight of about 950 and is sold by Infineum USA of Linden, N.J.

In some embodiments, the at least one polybutene polymer is a mixture of polybutenes and polyisobutylenes prepared from a $C_4$ olefin refinery stream containing about 6 wt. % to about 50 wt. % isobutylene with the balance a mixture of butene (cis- and trans-) isobutylene and less than 1 wt %. butadiene. For example, the polymer may be prepared via Lewis acid catalysis from a $C_4$ stream composed of 6-45 wt. % isobutylene, 25-35 wt. % saturated butenes and 15-50 wt. % 1- and 2-butenes. In some embodiments, the two-cycle lubricating composition comprises from about 0 wt. % to about 75 wt. %, about 5 wt. % to about 60 wt. %, about 10 wt. % to about 50 wt. %, about 15 wt. % to about 40 wt. %, about 20 wt. % to about 30 wt. %, or about 23 wt. % to about 27 wt. % of the at least one viscosity modifer.

In certain embodiments, the two-cycle lubricant composition comprises at least one solvent. Exemplary solvents may include liquid petroleum or synthetic hydrocarbon solvents having a boiling point not higher than about 300° C. at atmospheric pressure. Such a solvent may also have a flash point in the range of about 60-120° C. In certain embodiments, the at least one solvent is selected from one or more of kerosene, hydrotreated kerosene, middle distillate fuels, isoparaffinic and naphthenic aliphatic hydrocarbon solvents, dimers and higher oligomers of alkyl-alkyl olefins such as propylene-butene, and paraffinic and aromatic hydrocarbon solvents. Such solvents may contain functional groups other than carbon and hydrogen, provided such groups do not adversely affect performance of the two-cycle oil. Suitable solvents include naphthenic-type hydrocarbon solvents having a boiling point range of about 91.1° C. to about 113.9° C., such as "Exxsol D80" sold by Exxon Chemical Company. In some embodiments, the two-cycle lubricating composition comprises from about 0 wt. % to about 75 wt. %, about 5 wt. % to about 60 wt. %, about 10 wt. % to about 50 wt. %, about 15 wt. % to about 40 wt. %, about 20 wt. % to about 30 wt. %, or about 23 wt. % to about 27 wt. % of the at least one solvent.

In certain embodiments, the two-cycle lubricating composition comprises an estolide base oil having a kinematic viscosity equal to or less than about 12 cSt when measured at 100° C. In certain embodiments, the two-cycle lubricant composition comprises an estolide base oil having a kinematic viscosity equal to or less than about 11 cSt when measured at 100° C. In certain embodiments, the two-cycle lubricant composition comprises an estolide base oil having a kinematic viscosity equal to or less than about 10 cSt when measured at 100° C., such as about 1 to about 10, about 2 to about 9, about 4 to about 9, or about 5 to about 10 cSt at 100° C. In certain embodiments, depending on the overall formulation of the two-cycle lubricant composition, the use of an estolide base oil having a kinematic viscosity equal to or less than about 10 cSt when measured at 100° C., and/or an EN of less than 2 (e.g., EN of ≤1.5), will enable the formulation to meet or exceed one or more of the JASO standards described herein. Without being bound to any particular theory, in certain embodiments it is believed that having an estolide base oil that exhibits a kinematic viscosity of less than about 11 cSt when measured at 100° C. (e.g., equal to or less than 10 cSt), and/or an EN of less than 2 (e.g., EN of ≤1.6), will enable the two-cycle lubricating composition to meet or exceed the JASO M 340 Lubricity Index of ≥95 and/or the M 343 Exhaust Blocking of ≥90.

In certain embodiments, the estolide base oil comprises the balance of the composition after addition of the components of the additive package. In certain embodiments, the estolide base oil comprises about 1 to about 95% by weight of the two-cycle lubricant composition, such as about 1 to about 69 wt. %, about 15 to about 65 wt. %, about 25 to about 60 wt. %, about 35 to about 55 wt. %, about 40 to about 50 wt. %, or about 42 to about 46 wt. %.

The present disclosure is based on the surprising discovery that certain combinations of additives and estolide base stocks can provide a two-cycle lubricating composition exhibiting suitable properties which meet or exceed the JASO (Japanese Automobile Standards Organization) guidelines for the quality and performance of two-cycle gasoline engine oils, including those set forth under JASO M 345. The performance level of two-cycle oils is classified into three grades, FB, FC, and FD, according to the test results based on the JASO two-cycle oil test methods: M 342 Exhaust Smoke Index, M 341 3-Hour Detergency test (or "EGD Detergency"), M 340 Lubricity, M 340 Initial Torque, and M 343 Exhaust System Blocking . "EGD Detergency" is a reference to a further modification of the normal JASO M341 detergency test (1 hour) procedure in which the test is run for 3 hours. This is a more stringent standard expected to be adopted by ISO (the International Organization for Standardization).

The FC grade is defined for low smoke two-cycle oils superior to FB with regard to exhaust smoke and exhaust system blocking. FD grade is defined as an improved version of FC in terms of detergency performance at high temperatures. FD-grade performance limits for the various JASO methods are as follows:

M 342 Smoke Index: ≥85
M 341 3-Hour Detergency (fundamental part): ≥125
M 341 3-Hour Detergency (piston skirt part): ≥95
M 340 Lubricity Index: ≥95
M 340 Torque Index: ≥98
M 343 Exhaust Blocking: ≥90

In some embodiments, the two-cycle lubricating compositions described herein meet or exceed one or more of the FD-grade performance limits for said JASO methods. In some embodiments, the compositions meet or exceed all of the FD-grade performance limits for the four JASO methods described. For example, the compositions described may exhibit an M 342 Smoke Index of ≥85, ≥90, or ≥100. In some embodiments, the compositions described may exhibit an M 342 Smoke Index falling within the range of about 85 to about 120, such as about 90 to about 115, or about 95 to about 110.

In some embodiments, the compositions described may exhibit an M 341 3-Hour Detergency (fundamental part) of ≥125, ≥130, ≥140, or ≥150. In some embodiments, the compositions described may exhibit an M 341 3-Hour Detergency (fundamental part) falling within the range of about 125 to about 180, about 130 to about 150, or about 135 to about 140.

In some embodiments, the compositions described may exhibit an M 340 Lubricity Index of ≥95, ≥100, or ≥110. In some embodiments, the compositions described may exhibit an M 340 Lubricity Index falling within the range of about 95 to about 125, or about 100 to about 110.

In some embodiments, the compositions described may exhibit an M 340 Torque Index of ≥98, ≥100, or ≥105. In some embodiments, the compositions described may exhibit an M 340 Torque Index falling within the range of about 98 to about 115, or about 100 to about 105.

In some embodiments, the compositions described may exhibit an M 343 Exhaust Blocking of ≥90, ≥100, or ≥110. In some embodiments, the compositions described may exhibit an M 343 Exhaust Blocking Smoke falling within the range of about 90 to about 130, about 100 to about 125, or about 110 to about 120.

In addition to the above engine tests, JASO two-cycle oil standards indicate that three standard physiochemical properties must be met: kinematic viscosity (JIS K 2283), flash point (JIS K 2265), and sulfated ash mass % (JIS K 2272). FD-grade performance limits for those test methods are as follows:

JIS K 2283 viscosity: ≥6.5 cSt at 100° C.

JIS K 2265 flash point: ≥70° C.

JIS K 2272 sulfated ash mass: ≤0.18%

The FB and FC-grade performance limit for sulfated ash mass under JIS K 2272 is ≤0.25%. In some embodiments, the two-cycle lubricant compositions described herein meet or exceed one or more of the FD-grade physiochemical performance limits set forth under JASO standards. In some embodiments, the compositions meet or exceed all of the FD-grade physiochemical performance limits. For example, the compositions described may exhibit a kinematic viscosity of ≥6.5 cSt at 100° C., ≥7.0 cSt at 100° C., ≥7.5 cSt at 100° C., ≥8.0 cSt at 100° C., or ≥8.5 cSt at 100° C. In some embodiments, the compositions described may exhibit a kinematic viscosity falling within the range of about 6.5 cSt at 100° C. to about 15 cSt at 100° C., 6.5 cSt at 100° C. to about 14 cSt at 100° C., 6.5 cSt at 100° C. to about 12 cSt at 100° C., 6.5 cSt at 100° C. to about 10 cSt at 100° C., or about 7 cSt at 100° C. to about 10 cSt at 100° C.

In some embodiments, the compositions described may exhibit a flash point of ≥70° C., ≥85° C., or ≥100° C. In some embodiments, the compositions described may exhibit a flash point falling within the range of about 70° C. to about 200° C.

In some embodiments, the compositions described may exhibit a sulfated ash mass of ≤0.18%, ≤0.14%, or ≤0.12%. In some embodiments, the compositions described may exhibit a sulfated ash mass falling within the range of about 0.04% to about 0.18%.

As illustrated below, compound 100 represents an unsaturated fatty acid that may serve as the basis for preparing the estolide compounds described herein.

Scheme 1

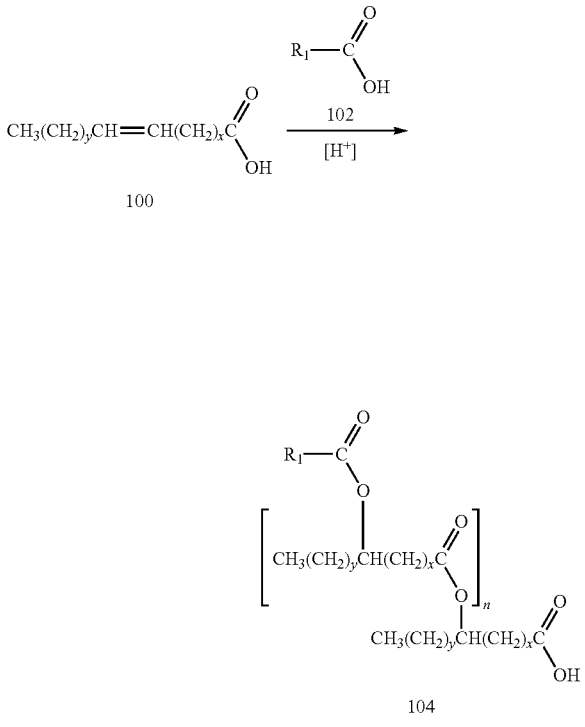

In Scheme 1, wherein x is, independently for each occurrence, an integer selected from 0 to 20, y is, independently for each occurrence, an integer selected from 0 to 20, n is an integer greater than or equal to 0, and $R_1$ is an optionally substituted alkyl that is saturated or unsaturated, and branched or unbranched, unsaturated fatty acid 100 may be combined with compound 102 and a proton from a proton source to form free acid estolide 104. In certain embodiments, compound 102 is not included, and unsaturated fatty acid 100 may be exposed alone to acidic conditions to form free acid estolide 104, wherein $R_1$ would represent an unsaturated alkyl group. In certain embodiments, if compound 102 is included in the reaction, $R_1$ may represent one or more optionally substituted alkyl residues that are saturated or unsaturated and branched or unbranched. Any suitable proton source may be implemented to catalyze the formation of free acid estolide 104, including but not limited to homogenous acids and/or strong acids like hydrochloric acid, sulfuric acid, perchloric acid, nitric acid, triflic acid, and the like.

Scheme 2

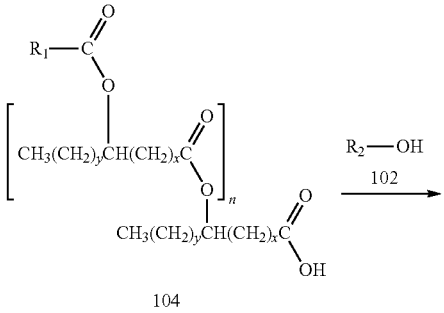

-continued

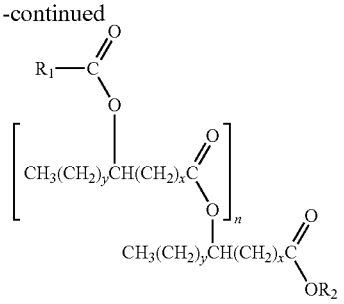

204

Similarly, in Scheme 2, wherein x is, independently for each occurrence, an integer selected from 0 to 20, y is, independently for each occurrence, an integer selected from 0 to 20, n is an integer greater than or equal to 1, and $R_1$ and $R_2$ are each an optionally substituted alkyl that is saturated or unsaturated, and branched or unbranched, free acid estolide 104 may be esterified by any suitable procedure known to those of skilled in the art, such as acid-catalyzed reduction with alcohol 202, to yield esterified estolide 204. Other exemplary methods may include other types of Fischer esterification, such as those using Lewis acid catalysts such as $BF_3$.

In all of the foregoing examples, the compounds described may be useful alone, as mixtures, or in combination with other compounds, compositions, and/or materials.

Methods for obtaining the novel compounds described herein will be apparent to those of ordinary skill in the art, suitable procedures being described, for example, in the examples below, and in the references cited herein.

EXAMPLES

Analytics

Nuclear Magnetic Resonance: NMR spectra were collected using a Bruker Avance 500 spectrometer with an absolute frequency of 500.113 MHz at 300 K using $CDCl_3$ as the solvent. Chemical shifts were reported as parts per million from tetramethylsilane. The formation of a secondary ester link between fatty acids indicating the formation of estolide was verified with $^1H$ NMR by a peak at about 4.84 ppm.

Estolide Number (EN): The EN was measured by GC analysis.

Iodine Value (IV): The iodine value is a measure of the total unsaturation of an oil. IV is expressed in terms of centigrams of iodine absorbed per gram of oil sample. Therefore, the higher the iodine value of an oil the higher the level of unsaturation is of that oil. Estimated by GC analysis.

Gas Chromatography (GC): GC analysis was performed to evaluate the estolide number (EN) and iodine value (IV) of the estolides. This analysis was performed using an Agilent 6890N series gas chromatograph equipped with a flame-ionization detector and an autosampler/injector along with an SP-2380 30 m×0.25 mm i.d. column.

The parameters of the analysis were as follows: column flow at 1.0 mL/min with a helium head pressure of 14.99 psi; split ratio of 50:1; programmed ramp of 120-135° C. at 20° C./min, 135-265° C. at 7° C./min, hold for 5 min at 265° C.; injector and detector temperatures set at 250° C.

Measuring EN and IV by GC: To perform this analysis, the fatty acid components of an estolide sample were reacted with MeOH to form fatty acid methyl esters by a method that left behind a hydroxy group at sites where estolide links were once present. Standards of fatty acid methyl esters were first analyzed to establish elution times.

Sample Preparation: To prepare the samples, 10 mg of estolide was combined with 0.5 mL of 0.5M KOH/MeOH in a vial and heated at 100° C. for 1 hour. This was followed by the addition of 1.5 mL of 1.0 M $H_2SO_4$/MeOH and heated at 100° C. for 15 minutes and then allowed to cool to room temperature. After which time, 1 mL of $H_2O$ and 1 mL of hexane were added to the vial and the resulting liquid phases were mixed thoroughly. The layers were then allowed to phase separate for 1 minute. The bottom $H_2O$ layer was removed and discarded. A small amount of drying agent ($Na_2SO_4$ anhydrous) was then added to the organic layer after which the organic layer was then transferred to a 2 mL crimp cap vial and analyzed.

EN Calculation: The EN is measured as the percent hydroxy fatty acids divided by the percent non-hydroxy fatty acids. As an example, a dimer estolide would result in half of the fatty acids containing a hydroxy functional group, with the other half lacking a hydroxyl functional group. Therefore, the EN would be 50% hydroxy fatty acids divided by 50% non-hydroxy fatty acids, resulting in an EN value of 1 that corresponds to the single estolide link between the capping fatty acid and base fatty acid of the dimer.

IV Calculation: The iodine value is estimated by the following equation based on ASTM Method D97 (ASTM International, Conshohocken, Pa.):

$$IV = \sum 100 \times \frac{A_f \times \mathrm{MW}_I \times db}{\mathrm{MW}_f}$$

$A_f$=fraction of fatty compound in the sample $MW_I$=253.81, atomic weight of two iodine atoms added a double bond db=number of double bonds on the fatty compound $MW_f$=molecular weight of the fatty compound The properties of the exemplary estolide base stocks and two-cycle formulations described herein are identified in Tables 1-4.

Other Measurements: Except as otherwise described, pour point is measured by ASTM Method D97, cloud point is measured by ASTM Method D2500, viscosity/kinematic viscosity is measured by ASTM Method D445, and viscosity index is measured by ASTM Method D2270.

Example 1

The acid catalyst reaction was conducted in a 50 gallon Pfaudler RT-Series glass-lined reactor. Oleic acid (65 Kg, OL 700, Twin Rivers) was added to the reactor with 70% perchloric acid (992.3 mL, Aldrich Cat #244252) and heated to 60° C. in vacuo (10 torr abs) for 24 hrs while continuously being agitated. After 24 hours the vacuum was released. 2-Ethylhexanol (29.97 Kg) was then added to the reactor and the vacuum was restored. The reaction was allowed to continue under the same conditions (60° C., 10 torr abs) for 4 more hours. At which time, KOH (645.58 g) was dissolved in 90% ethanol/water (5000 mL, 90% EtOH by volume) and added to the reactor to quench the acid. The solution was then allowed to cool for approximately 30 minutes. The contents of the reactor were then pumped through a 1μ filter into an accumulator to filter out the salts. Water was then added to the accumulator to wash the oil. The two liquid phases were thoroughly mixed together for approximately 1 hour. The solution was then allowed to phase separate for approximately 30 minutes. The water layer was drained and disposed of. The organic layer was again pumped through a 1μ filter back into the reactor. The reactor was heated to 60° C. in vacuo (10 ton abs) until all ethanol and water ceased to distill from solution. The reactor was then heated to 100° C. in vacuo (10 torr abs) and that temperature was maintained until the 2-ethylhexanol ceased to distill form solution. The remaining material was then distilled using a Myers 15 Centrifugal Distillation still at 200° C. under an absolute pressure of approximately 12 microns (0.012 torr) to remove all monoester material leaving behind estolides.

Example 2

The acid catalyst reaction was conducted in a 50 gallon Pfaudler RT-Series glass-lined reactor. Oleic acid (50 Kg, OL 700, Twin Rivers) and whole cut coconut fatty acid (18.754 Kg, TRC 110, Twin Rivers) were added to the reactor with 70% perchloric acid (1145 mL, Aldrich Cat #244252) and heated to 60° C. in vacuo (10 torr abs) for 24 hrs while continuously being agitated. After 24 hours the vacuum was released. 2-Ethylhexanol (34.58 Kg) was then added to the reactor and the vacuum was restored. The reaction was allowed to continue under the same conditions (60° C., 10 torr abs) for 4 more hours. At which time, KOH (744.9 g) was dissolved in 90% ethanol/water (5000 mL, 90% EtOH by volume) and added to the reactor to quench the acid. The solution was then allowed to cool for approximately 30 minutes. The contents of the reactor were then pumped through a 1μ0 filter into an accumulator to filter out the salts. Water was then added to the accumulator to wash the oil. The two liquid phases were thoroughly mixed together for approximately 1 hour. The solution was then allowed to phase separate for approximately 30 minutes. The water layer was drained and disposed of. The organic layer was again pumped through a 1μ filter back into the reactor. The reactor was heated to 60° C. in vacuo (10 torr abs) until all ethanol and water ceased to distill from solution. The reactor was then heated to 100° C. in vacuo (10 torr abs) and that temperature was maintained until the 2-ethylhexanol ceased to distill form solution. The remaining material was then distilled using a Myers 15 Centrifugal Distillation still at 200° C. under an absolute pressure of approximately 12 microns to remove all monoester material leaving behind estolides.

Example 3

The estolides produced in Example 2 were subjected to distillation conditions in a Myers 15 Centrifugal Distillation still at 300° C. under an absolute pressure of approximately 12 microns (0.012 torr). This resulted in a primary distillate having a lower EN average (Ex. 3A), and a distillation residue having a higher EN average (Ex. 3B).

Example 4

Estolides were prepared according to the method set forth in Example 2, except the reaction was initially charged with 41.25 Kg of Oleic acid and 27.50 Kg of whole cut coconut fatty acids, to provide an estolide product (Ex. 4).

Example 5

Estolides produced according to the method set forth in Example 4 (Ex. 4) were subjected to distillation conditions in a Myers 15 Centrifugal Distillation still at 300° C. under an absolute pressure of approximately 12 microns (0.012 torr). This resulted in a primary distillate having a lower viscosity (Ex. 5A), and a distillation residue having a higher viscosity (Ex. 5B).

Example 6

Estolides were prepared according to the methods set forth in Examples 4 and 5 to provide estolide products of Ex. 4, Ex. 5A, and Ex. 5B, which were subsequently subjected to a basic anionic exchange resin wash to lower the estolides' acid value: separately, each of the estolide products (1 equiv) were added to a 30 gallon stainless steel reactor (equipped with an impeller) along with 10 wt. % of Amberlite™ IRA-402 resin. The mixture was agitated for 4-6 hrs, with the tip speed of the impeller operating at no faster than about 1200 ft/min. After agitation, the estolide/resin mixture was filtered, and the recovered resin was set aside. Properties of the resulting low-acid estolides are set forth below in Table 1, which are labeled Ex. 4*, Ex. 5A*, and Ex. 5B*.

Example 7

Estolides were prepared according to the methods set forth in Examples 4 and 5. The resulting Ex. 5A and 5B estolides were subsequently hydrogenated via 10 wt. % palladium embedded on carbon at 75° C. for 3 hours under a pressurized hydrogen atmosphere to provide hydrogenated estolide compounds (Ex. 7A and 7B, respectively). The hydrogenated Ex. 7 estolides were then subjected to a basic anionic exchange resin wash according to the method set forth in Example 6 to provide low-acid estolides (Ex. 7A* and 7B*). The properties of the resulting low-acid Ex. 7A* and 7B* estolides are set forth below in Table 1.

TABLE 1

| Estolide Base Stock | EN | Pour Point ° C. (ASTM D97) | Cloud Point ° C. (ASTM D2500) | Viscosity 40° C. (ASTM D445) | Viscosity 100° C. (ASTM D445) | Viscosity Index (ASTM D2270) | Iodine Value (cg/g) |
|---|---|---|---|---|---|---|---|
| Ex. 2 | 1.82 | −33 | −32 | 65.4 | 11.3 | 167 | 13.2 |
| Ex. 1 | 2.34 | −40 | −33 | 91.2 | 14.8 | 170 | 22.4 |
| Ex. 3A | 1.31 | −30 | −30 | 32.5 | 6.8 | 175 | 13.8 |
| Ex. 3B | 3.22 | −36 | −36 | 137.3 | 19.9 | 167 | 9.0 |
| Ex. 4* | 1.86 | −29 | −36 | 52.3 | 9.6 | 170 | 12 |
| Ex. 5A* | 1.31 | −27 | −30 | 35.3 | 7.2 | 172 | 13 |
| Ex. 5B* | 2.94 | −33 | −36 | 137.3 | 19.9 | 167 | 7 |
| Ex. 7A* | 1.31 | −18 | −15 | 35.3 | 7.2 | 173 | <5 |
| Ex. 7B* | 2.94 | −27 | −24 | 142.7 | 20.9 | 171 | <5 |

Example 8

Various two-cycle lubricating compositions were formulated and tested for compliance with JASO FD grade standards. The compositions of two-stroke formulations I-VI are set forth in Table 2. Performance results of formulations I-VI, as compared to certain JASO FD-grade minimums, are set forth in Table 3. Table 4 includes additional physical properties of formulation VI.

TABLE 2

| 2-Cycle Form. | Base Stock (%) | Base Stock EN | Visc. Of Base Stock (100° C.) | Solvent (%) | Polymer (%) | Additives (%) |
|---|---|---|---|---|---|---|
| I | Ex. 1 (40.5) | 2.34 | 14.8 cSt | Monoester* (40) | PIB S1054 (15) | S911 Deter. (4.5) |
| II | Ex. 1 (35.3) | 2.34 | 14.8 cSt | Monoester (30) | PIB S1054 (30) | S911 Deter. (4.5) |
| III | Ex. 1 (47.16) | 2.34 | 14.8 cSt | Monoester (18.34) | PIB S1054 (30) | S911 Deter. (4.5) |
| IV | Ex. 2 (30.5) Ex. 3B (14) | 2.26 | 13.85 cSt | Exxsol D80 (25) | PIB S1054 (25) | S911 Deter. (4.5) Aminic antiox. (1) |
| V | Ex. 2 (44.5) | 1.82 | 11.3 cSt | Exxsol D80 (25) | PIB S1054 (25) | S911 Deter. (4.5) Aminic antiox. (1) |
| VI | Ex. 7A* (30.5) Ex. 7B* (14) | 1.48 | 8.17 cSt | Exxsol D80 (25) | PIB S1054 (25) | S911 Deter. (4.5) Aminic antiox. (1) |

*Monoester "solvents" referenced in Table 2 comprise about 97% esterified fatty acid 2-ethylhexyl monoesters formed in Example 1, and about 3% 2-ethylhexyl estolides.

TABLE 3

| Test Method | Grade (FD, min.) | I | II | III | IV | V | VI |
|---|---|---|---|---|---|---|---|
| M 341 JASO 3 hr Detergency (fund. Part) | 125 | — | — | 109 | 125 | — | 138 |
| M 341 JASO 3 hr Detergency (skirt part) | 95 | — | — | 84 | 111 | — | 112 |
| M 340 JASO Lubricity | 95 | — | 92 | 102 | — | — | 102 |
| M 340 JASO Torque | 98 | — | 102 | 101 | — | — | 100 |
| M 343 JASO Blocking | 90 | — | — | — | 74 | 79 | 113 |
| M 342 JASO Smoke | 85 | 71 | 93 | 85 | 103 | — | 106 |
| Overall Result | — | Fail | Fail | Fail | Fail | Fail | Pass |

TABLE 4

| Item | Test Method JIS K or JPI | Test Method ASTM | Measured Value |
|---|---|---|---|
| Density (15° C.) g/cm$^3$ | K 2249 | D 1298 | 0.8697 |
| Flash Point ° C. | K 2265 | D 92 or D93 | 90 |
| Kinematic Viscosity (40° C.) mm$^{2/s}$ | K 2283 | D 445 | 31.44 |
| Kinematic Viscosity (100° C.) mm$^2$/s | K 2283 | D 445 | 6.65 |
| Viscosity Index | K 2283 | D 2270 | 174 |
| Carbon Residue Mass % | K 2270 | D 189 | 0.16 |
| Sulfated Ash Mass % | K 2272 | D 874 | 0.13 |
| Total Acid Number mg KOH/g | K 2501 | D 664 | 0.52 |
| Total Base No. ($HClO_4$ Method) mg KOH/g | K 2501 | D 2896 | 3.34 |

TABLE 4-continued

| | | | |
|---|---|---|---|
| Pour Point ° C. | K 2269 | D 97 | -2.7 |
| Color (Visual Inspection) | | D130 | 2 |
| Elemental Analysis Mass % Calcium | JPI-5S-38-92 | D 4951 | 0.0479 |
| Barium | JPI-5S-38-92 | D 4951 | <0.0001 |
| Magnesium | JPI-5S-38-92 | D 4951 | 0.0003 |
| Zinc | JPI-5S-38-92 | D 4951 | <0.0001 |
| Boron | JPI-5S-38-92 | D 4951 | <0.0001 |
| Phosphorus | JPI-5S-38-92 | D 4951 | <0.0001 |
| Nitrogen | K 2609-1990 | D 4629 | 0.074 |
| Sulfur | K 2541-1992 | D 2622 | 0.006 |
| Other Elements >100 ppm (Except Carbon, Hydrogen, and Oxygen) | | | None |

The invention claimed is:

1. A two-cycle lubricating composition comprising:

(i) about 40 to about 50% by weight of an estolide base oil having a kinematic viscosity of about 4 to about 10 cSt at 100° C., said estolide base oil comprising at least one estolide compound selected from compounds of Formula I:

Formula I

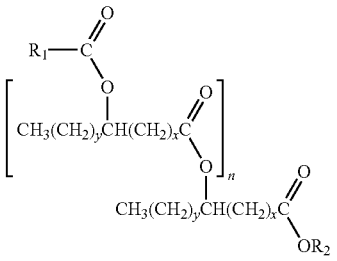

wherein x is, independently for each occurrence, an integer selected from 7 and 8;

y is, independently for each occurrence, an integer selected from 7 and 8;

n is an integer selected from 0, 1, and 2;

$R_1$ is an optionally substituted $C_1$ to $C_{22}$ alkyl that is saturated and unbranched; and $R_2$ is an optionally substituted $C_1$ to $C_{22}$ alkyl that is saturated and branched, wherein each fatty acid chain residue is unsubstituted;

(ii) about 3 to about 6% by weight of at least one detergent comprising an overbased calcium detergent;

(iii) about 23 to about 27% by weight of at least one viscosity modifier comprising a polybutene polymer;

(iv) about 23 to about 27% by weight of at least one solvent comprising a petroleum solvent or synthetic hydrocarbon solvent, and (v) at least one antioxidant, wherein said composition exhibits a JASO M 343 Exhaust Blocking Index of at least 90.

2. The two-cycle lubricating composition according to claim 1, wherein the estolide base oil has a kinematic viscosity of 6.5 to 10 cSt at 100° C.

3. The two-cycle lubricating composition according to claim 1, wherein the polybutene polymer comprises a poly-n-butenes and/or polyisobutylenes having a number average molecular weight of 300 to 1500.

4. The two-cycle lubricating composition according to claim 1, wherein the at least one solvent comprises a petroleum solvent or synthetic hydrocarbon solvent, said at least one solvent having a boiling point not higher than 380° C. at atmospheric pressure.

5. The two-cycle lubricating composition according to claim 1, wherein the at least one antioxidant comprises an aminic antioxidant.

6. The two-cycle lubricating composition according to claim 5, wherein the aminic antioxidant comprises a diarylamine antioxidant.

7. The two-cycle lubricating composition according to claim 1, wherein $R_2$ is selected from $C_6$ to $C_{12}$ alkyl.

8. The two-cycle lubricating composition according to claim 1, wherein the estolide base oil exhibits an iodine value equal to or less than 15 cg/g.

9. The two-cycle lubricating composition according to claim 1, wherein the estolide base oil exhibits an iodine value equal to or less than 10 cg/g.

10. The two-cycle lubricating composition according to claim 1, wherein the estolide base oil has an EN that is an integer or fraction of an integer selected from 1 to 1.5.

11. The two-cycle lubricating composition according to claim 1, wherein the estolide base oil has an EN less than or equal to 1.6.

12. The two-cycle lubricating composition according to claim 1, wherein the detergent comprises an overbased calcium detergent having a total base number of 150 to 450.

13. The two-cycle lubricating composition according to claim 1, wherein the at least one antioxidant is present in an amount of 1 to 2% by weight.

* * * * *